US006338539B1

(12) United States Patent
Kobayashi et al.

(10) Patent No.: US 6,338,539 B1
(45) Date of Patent: Jan. 15, 2002

(54) INK JET RECORDING DEVICE

(75) Inventors: Atsushi Kobayashi; Seiji Mochizuki; Kazuhisa Kawakami; Shigenori Fukasawa; Masahiro Isono; Masahiro Nakamura; Nobutoshi Ohtsuka; Nobuhito Takahashi; Hitoshi Hayakawa; Norihiro Maruyama, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 08/975,663

(22) Filed: Nov. 21, 1997

(30) Foreign Application Priority Data

| | | |
|---|---|---|
| Nov. 22, 1996 | (JP) | 8-327838 |
| Sep. 8, 1997 | (JP) | 9-259350 |
| Sep. 8, 1997 | (JP) | 9-259351 |
| Sep. 8, 1997 | (JP) | 9-259352 |
| Sep. 8, 1997 | (JP) | 9-259353 |

(51) Int. Cl.[7] ..... B41J 2/165

(52) U.S. Cl. ..... 347/23; 347/50; 347/3; 347/108

(58) Field of Search ..... 347/23, 50, 3, 347/108, 19, 87, 30, 35

(56) References Cited

U.S. PATENT DOCUMENTS

| | | | |
|---|---|---|---|
| 5,506,611 A | 4/1996 | Ujita et al. | 347/86 |
| 5,719,612 A * | 2/1998 | Hirakue | 347/108 |

FOREIGN PATENT DOCUMENTS

| | | | |
|---|---|---|---|
| EP | 0480473 | 4/1992 | |
| EP | 0 480 473 A1 | 4/1992 | B41J/2/165 |
| EP | 0 535 686 A2 | 4/1993 | B41J/2/165 |
| EP | 0552472 | 7/1993 | |
| EP | 0 552 472 A2 | 7/1993 | B41J/2/165 |
| EP | 0 615 846 A1 | 9/1994 | B41J/2/175 |
| EP | 0 626 267 A2 | 11/1994 | B41J/25/34 |
| GB | 2289868 | 12/1995 | |
| GB | 2 289 868 | 12/1995 | B41J/2/175 |
| JP | 7-323576 | 12/1995 | B41J/2/175 |
| WO | WO97/23352 | 7/1997 | B41J/2/17 |
| WO | WO 9723352 | 7/1997 | |

* cited by examiner

*Primary Examiner*—John Barlow
*Assistant Examiner*—Charles W. Stewart, Jr.
(74) *Attorney, Agent, or Firm*—Sughrue, Mion, Zinn, Macpeak & Seas, PLLC

(57) ABSTRACT

An ink jet recording device includes an external switch, a device for detecting the amount of ink left in each ink cartridge, and a device operating such that when an instruction to replace the ink cartridge is generated by the switch, or when a device detects an ink end of the cartridge, only the ink cartridge to be replaced is exposed through a window in the recording device. The ink cartridge to be replaced is specified, and only the specified ink cartridge is automatically moved to a replaceable position. Correct replacement of more than one ink cartridge is ensured, and the cartridge replacing work is simplified.

38 Claims, 15 Drawing Sheets

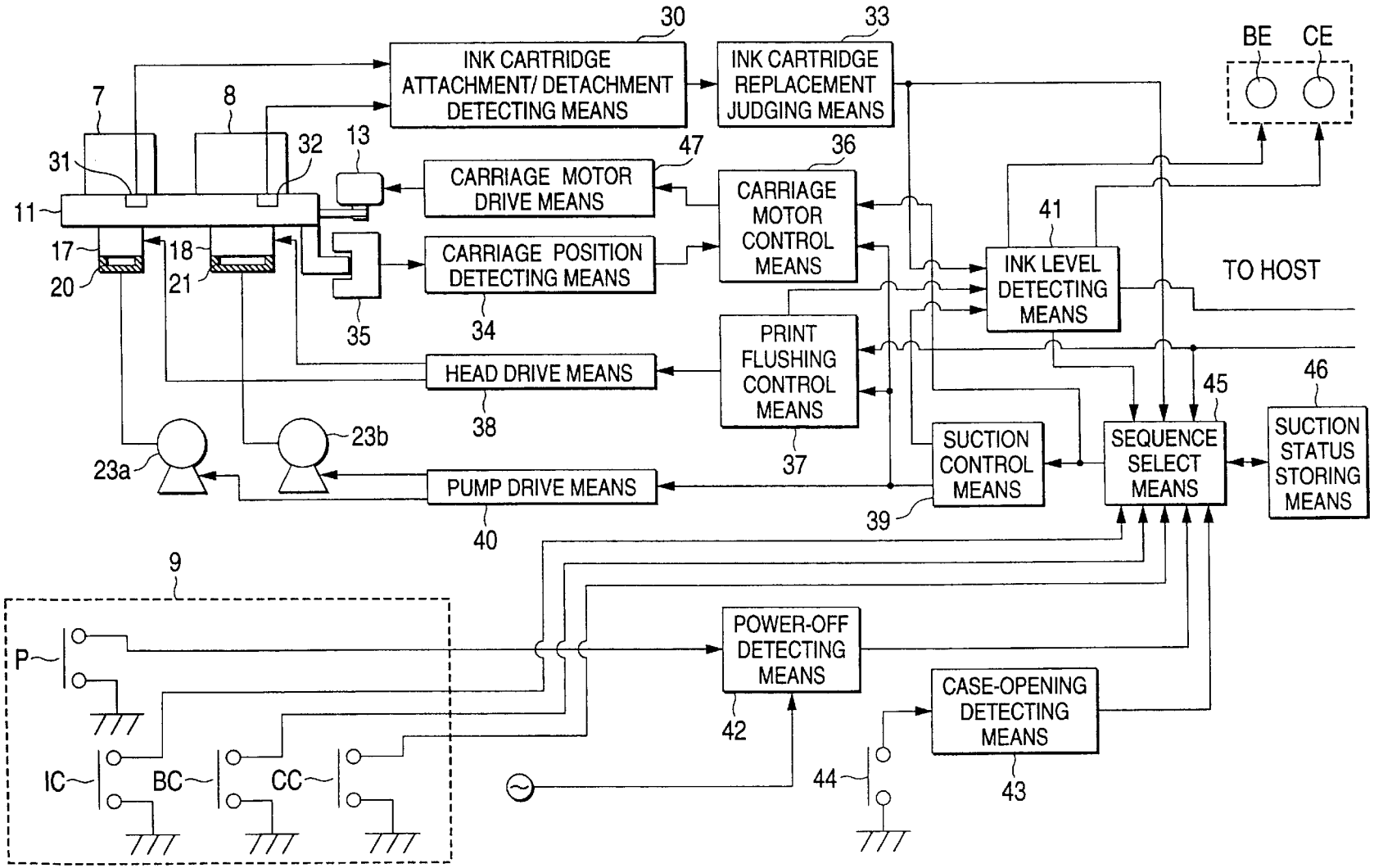
FIG. 3
BE
CE
TO HOST
46
SUCTION STATUS STORING MEANS
45
SEQUENCE SELECT MEANS
41
INK LEVEL DETECTING MEANS
SUCTION CONTROL MEANS
39
CASE-OPENING DETECTING MEANS
43
44
33
INK CARTRIDGE REPLACEMENT JUDGING MEANS
36
CARRIAGE MOTOR CONTROL MEANS
PRINT FLUSHING CONTROL MEANS
37
POWER-OFF DETECTING MEANS
42
30
INK CARTRIDGE ATTACHMENT/ DETACHMENT DETECTING MEANS
47
CARRIAGE MOTOR DRIVE MEANS
CARRIAGE POSITION DETECTING MEANS
34
HEAD DRIVE MEANS
38
PUMP DRIVE MEANS
40
13
35
23b
32
8
18
21
7
31
17
20
11
23a
9
CC
BC
IC
P

INK JET RECORDING DEVICE

BACKGROUND OF THE INVENTION

1. Field of the Invention

The present invention relates to an ink jet printer of the type in which a plurality of ink jet print heads and a plurality of ink cartridges for supplying ink to the print heads are mounted on a carriage movable in the widthwise direction of a printing medium, and the print heads eject ink drops of different colors onto a printing medium in accordance with print data, to thereby print characters and images on the printing medium. More particularly, the invention relates to the technique of replacing ink cartridges.

2. Related Art

A recording device (referred to simply an a printer) with an ink jet print head has the following advantageous features: relatively low noise is generated at the time of printing, and small dots are formed at high density. Because of these features, the print head is used in a variety of printings inclusive of a color printing. Particularly, with the features of a further improvement of recording density and the capability of the color printing, an ink jet print head in which a black ink print head and a color ink print head are mounted on the carriage is put into practice. To reduce the size of the printer and simplify the ink supplying system, the printer is constructed such that ink cartridges for respectively supplying a black ink and colored inks to the print heads are mounted on the carriage.

When the ink cartridges of this type are attached to the carriage, air enters the passages of the print heads through their connection parts. To prevent air from entering, in a printer of the type in which two ink cartridges are mounted on the carriage, the ink cartridge which is to be replaced with a new one is specified by operating a related switch on a panel of the case of the printer, and a negative pressure is applied to the print head, to forcibly charge and discharge ink to and from the print head.

The specifying of the replaced ink cartridge depends on the user's switch operation, if the user mistakenly operates the switch, ink is not charged into the new ink cartridge and the printer fails to print or ink is charged into the ink cartridge that was not replaced, resulting in a wasteful use of ink.

To solve these problems, an ink jet printer is proposed in Japanese Patent Laid-Open Publication No. Hei. 7-323576, for example. The printer includes an ink cartridge replacement history judging means for detecting an attaching of the ink cartridge by use of a signal derived from an ink cartridge detecting means. When the attaching of the ink cartridge is detected, ink is charged into the replaced ink cartridge.

The proposed printer succeeds in that it allows the ink to be charged into only the replaced ink cartridge, and inhibits the ink from being sucked from the ink cartridges that are not replaced. However, the user per se must specify the ink cartridge to be replaced. Therefore, idle attaching/detaching operations of the ink cartridges are inevitably performed. The result is the entering of air bubbles into the print head and defective printing.

The ink jet printer is constructed such that a pressure generating chamber pressurizes the ink to discharge the ink from a discharge orifice. Because of this construction, during shipping the printer must be placed in the same condition as when the printer is operated. To this end, the ink cartridges of the printer are filled with a liquid for shipping, to thereby prevent the print heads from being dried and clogged with dust.

For this reason, an initial charging operation is required. In this operation, the shipping liquid is completely removed from the ink cartridges before the first use of the printer, and the ink is charged from the ink cartridge into the associated print head such that the bubbles are completely removed from the print head. A process that is to be carried out when the ink cartridges are first attached to the printer delivered from the factory is performed by the user. Therefore, there is a possibility that the ink is erroneously charged. If the ink charging is erroneous, the printer will fail to perform a normal printing operation, as a matter of course. If the power supply is interrupted during the ink charging operation, the ink charging operation stops in the midst of the charging operation. To return the half-charged state of the print head to its original state, the user must do a complicated restoring manipulation. If he or she fails to correctly perform the manipulation, there is a danger that the recovery from the half-charged state is impossible.

SUMMARY OF THE INVENTION

According to the present invention, an ink jet recording device comprises an ink jet print head for ejecting different color ink in the form of ink drops; ink cartridges for supplying the ink to the print head; a carriage on which the print head and the ink cartridges are mounted; capping means for sealing the print head, the capping means being located outside a print section; suction means for applying a negative pressure to the capping means; a window allowing the ink cartridges to be exposed in a replaceable fashion; a switch being externally operable; and control means for moving only the ink cartridge to be replaced to a position confronted with the window in a replaceable fashion. With such a construction, when an ink cartridge or cartridges are to be replaced, only the ink cartridge that is to be replaced is selected and automatically moved to a replaceable position.

Accordingly, a first object of the present invention is to provide an ink jet recording device with ink cartridges which provide a simplification of the cartridge replacing work and succeed in eliminating erroneous cartridge replacing operations.

A second object of the present invention is to provide an ink jet recording device which automatically executes an initial ink charging operation to make the recording device ready for printing.

A third object of the present invention is to provide an ink jet recording device in which, even if the supply of electric power is interrupted during the cartridge replacing operation, a process necessary after the power supply interruption is automatically executed in response to the restart of the power supplying, and ink is charged into the print head to make the recording device ready for printing.

BRIEF DESCRIPTION OF THE DRAWINGS

FIG. 3 is a block diagram showing a control unit of the ink jet printer;

DETAILED DESCRIPTION OP THE PREFERRED EMBODIMENTS

Figure 1:
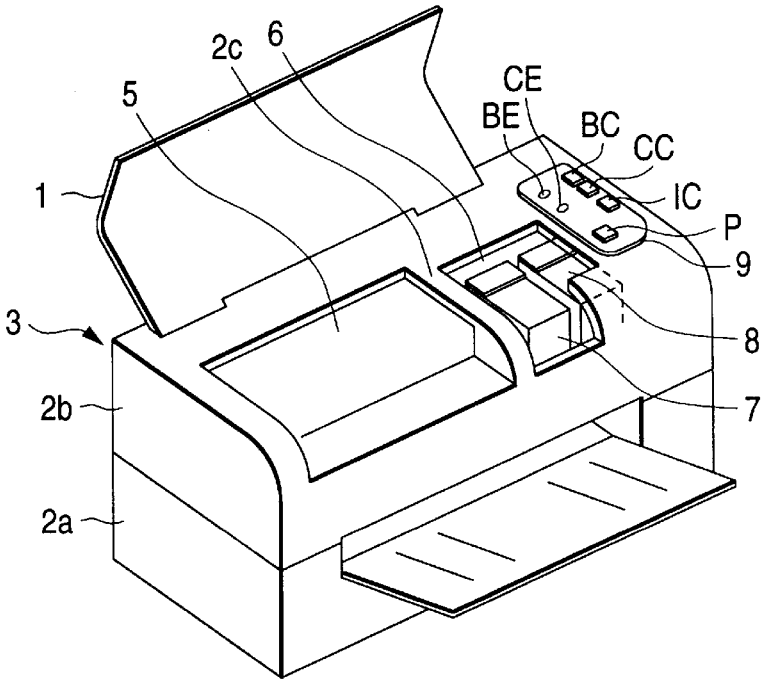
FIG. 1 is a perspective view showing an ink jet recording device or printer according to one embodiment of the present invention, the printer being illustrated in a state in which a case cover is open.

FIG. 1 shows an ink jet recording device (such as an ink jet printer) according to one embodiment of the present invention. A case 3 is formed with a case cover 1 that may be opened and closed, and a case body 2. A printing mechanism to be described later is disposed in the case 3. To windows 5 and 6 are formed in the case body 2, and a partitioning portion 2*c* is provided between these windows, so as to partition the case body 2 into a print section and a nonprint section.

The window 6 formed in the nonprint section is dimensioned and shaped so that the entire upper surface of either of two ink cartridges 7 and 8 is exposed through the window and at least a part of the upper surface of the remaining ink cartridge is covered by the case body 2. An operation panel 9 is provided on a portion of the case body 2, which is not covered with the case cover 1 when it is closed. The operation panel 9 includes a power switch P-SW, ink cartridge replacement switch IC-SW, black head cleaning instruction switch BC-SW, color head cleaning instruction switch CC-SW, line feed switch, reset switch and the like, and ink end indicators BE and CE for black and color ink cartridges, respectively.

Figure 2:
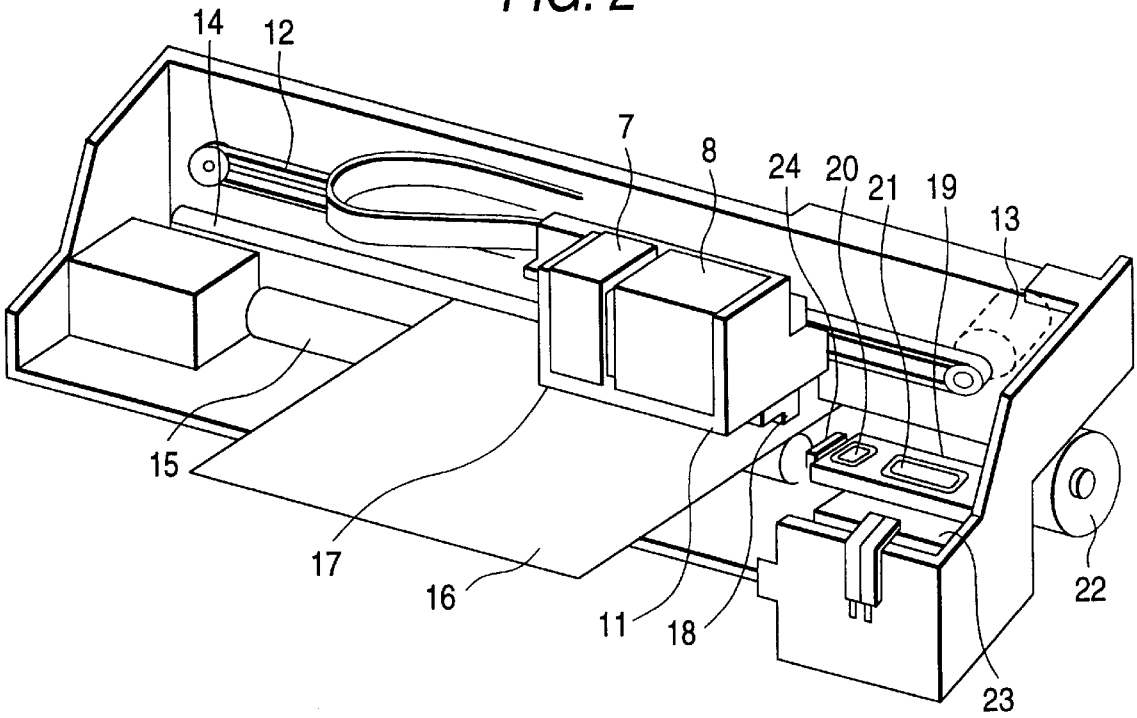
FIG. 2 is a perspective view showing a recording mechanism of the ink jet printer.

FIG. 2 shows the printing mechanism of the ink jet printer. A carriage 11 is connected to a carriage drive motor 13 by means of a timing belt 12. The carriage 11 is horizontally moved in a reciprocative fashion while being guided by a platen 15. A print head 17 for black ink ejection and another print head 18 for color printing are firmly attached to the carriage 11. The print head 17 is located in the print section (on the left hand in the figure), while the print head 18 is located in the nonprint section (on the right hand). These print heads confront a printing medium 16, e.g., a paper. The print heads 17 and 18 receive ink from the black ink cartridge 7 and the color ink cartridge 8, respectively, and eject ink droplets onto the printing medium 16.

A capping unit 19 is disposed in the nonprint section. In the capping unit 19, a cap 20 for capping the print head 17 and a cap 21 for capping the color ink print head 18 are mounted on a slider. These caps are coupled with a dual-pump unit 23 that is driven by a motor 22, by way of tubes, and independently receive negative pressures.

The caps 20 and 21 are shaped like caps made of an elastic material, e.g., rubber. Those caps are dimensioned so as to seal the orifice surfaces of the print heads 17 and 18 with closed spaces, respectively. In a nonprint mode, the caps 20 and 21 seal the nozzle surfaces of the print heads 17 and 18, respectively. In a discharging-capability recovering operation or when the ink cartridges 7 and 8 are replaced with new ones, the dual-pump unit 23 applies negative pressures to those print heads to forcibly discharge the ink from the heads. A cleaning unit 24 is located near the capping unit 19. The cleaning unit, when driven by a drive source (not shown), presses a wiping blade against the orifice surfaces of the print heads 17 and 18.

FIG. 3 shows an embodiment of a control unit for the ink cartridge replacing operation of the printer and for executing a clogging-removal process. An ink cartridge attachment/detachment detecting means 30 receives signals from switches 31 and 32, to thereby detect the attachment and detachment of the ink cartridges 7 and 8. Those switches are to be pressed against the positions on the carriage 11 being confronted with the ink cartridges 7 and 8, or the cartridge receiving surfaces of the carriage 11 in this embodiment. An ink cartridge replacement judging means 33 receives a signal from the cartridge attachment/detachment detecting means 30, and judges whether or not the ink cartridge 7 or 8 has been replaced with another in accordance with the received signal.

A carriage position detecting means 34 responds to a signal from a carriage position detector 35 and produces a signal on the following positions: at least a home position of the carriage 11, a first replacement position where the first ink cartridge 7 confronts the window 6, a second replacement position where the second ink cartridge 8 confronts the window 6, a flushing position where it receives the ink from the ink cartridges 7 and 8 when the flushing operation is carried out, i.e., positions where it confronts the caps 20 and 21 in this embodiment, cleaning positions where the ink cartridges 7 and 8 may be wiped or rubbed with is the cleaning unit 24, and the like.

A carriage motor control means 36, under control of a sequence select means 45, drives the carriage drive motor 13 through a CR (carriage) motor drive means 47 to reciprocatively move the carriage 11 for printing. Further, the carriage motor control means 36 receives signals from a suction control means 39 to be described later and the carriage position detecting means 34, and moves the carriage 11 to the home position, first replacement position, second replacement position, flushing position, and the cleaning position in accordance with those received signals. When the replacing of the ink cartridge 7 or 8 is normally completed, the carriage motor control means 36 moves the carriage 11 to the home position by a lower torque or at a lower speed than in a normal state or a combination of them.

A print/flushing control means 37 receives print data from a host computer, and in accordance with the print data, causes a head drive means 38 to output a drive signal to the print heads 17 and 18 which in turn eject ink droplets or drops. When the print heads 17 and 18 are put at the flushing positions, the print/flushing control means 37 outputs a drive signal to those print heads by way of the head drive means, whereby the print heads discharge ink drops through all their discharging orifices. By the discharging operation of ink drops, ink of increased viscosity is discharged into the ink receiver.

The suction control means 39, under control of the sequence select means 45, outputs a control signal to a pump drive means 40. In accordance with the control signal, the capping unit 19 caps the print heads 17 and 18 with the caps, and suction forces and suction times of the suction pumps 23*a* and 23*b* of the dual-pump unit 23 are controlled so as to cause the print heads 17 and 18 to discharge ink for the recovery of their ink discharging capabilities. Further, when the ink cartridges 7 and 8 are replaced with new ones, the suction control means 39 causes the ink cartridges 7 and 8 to charge inks to the print heads 17 and 18.

An ink level detecting means 41 integrates the number of printed dots, the number of ink drops discharged in the flushing operation, and the amount of ink consumed in the ink charging operation and cleaning operation, and computes an ink level of inks still left in the ink cartridges 7 and 8 on the basis of the result of the integration. When the ink cartridges 7 and 8 are replaced with new ones, the ink level detecting means 41 resets the integrated values. When an instruction to replace at least one of the ink cartridges 7 and 8 is issued, the ink level detecting means 41 checks an ink level of the ink left in the other ink cartridge. When the amount of the ink left is less than the amount of ink consumed by the sucking operation carried out at the time of the cartridge replacement, the ink level detecting means 41 judges that the ink level of the ink left in the ink cartridge 7 or 8 is an ink end level.

A power-off detecting means 42 detects an "on" or "off" state of a power switch P. When the power source is turned off, the power-off detecting means 42 executes a predetermined process and stops the supply of electric power to the printer. A case opening detecting means 43 receives a signal derived from a switch 44, which operates responsive to the opening/closing of the case cover 1, and produces a signal indicative of an opening/closing of the case cover 1.

The sequence select means 45 receives signals from the ink cartridge replacement switch IC, black head cleaning instruction switch BC, and the color head cleaning instruction switch CC on the panel 9, the power-off detecting means 42, case opening detecting means 43, ink level detecting means 41, and the host computer, and supervises the operations on an overall process, power-on process, power-off process, cleaning process, ink level check process, print process, ink cartridge replacement process, and the like in accordance with flow charts to be described later. Further, the sequence select means 45 stores various statuses ensuring from the ink cartridge replacement into a suction status storing means 46 when the power off process is executed.

The suction status storing means 46 stores data to set an initial charging flag to an off state when the printers are delivered from factories. When a user receives the printer and completes an initial ink charging, the initial charging flag is set to an on state. The suction status storing means 46 further includes memory areas for stowing statuses of the suction operations fox the ink cartridges 7 and 8, statuses of replacements of the ink cartridges 7 and 8, and the amount of ink left in the ink cartridges.

The operations of the printer thus constructed will be described with reference to the flow charts shown in FIGS. 4 to 12.

A. Description on the Overall Operation

When the power switch P is turned on, the sequence select means 45 executes a power-on process (step S100).

Figure 5:
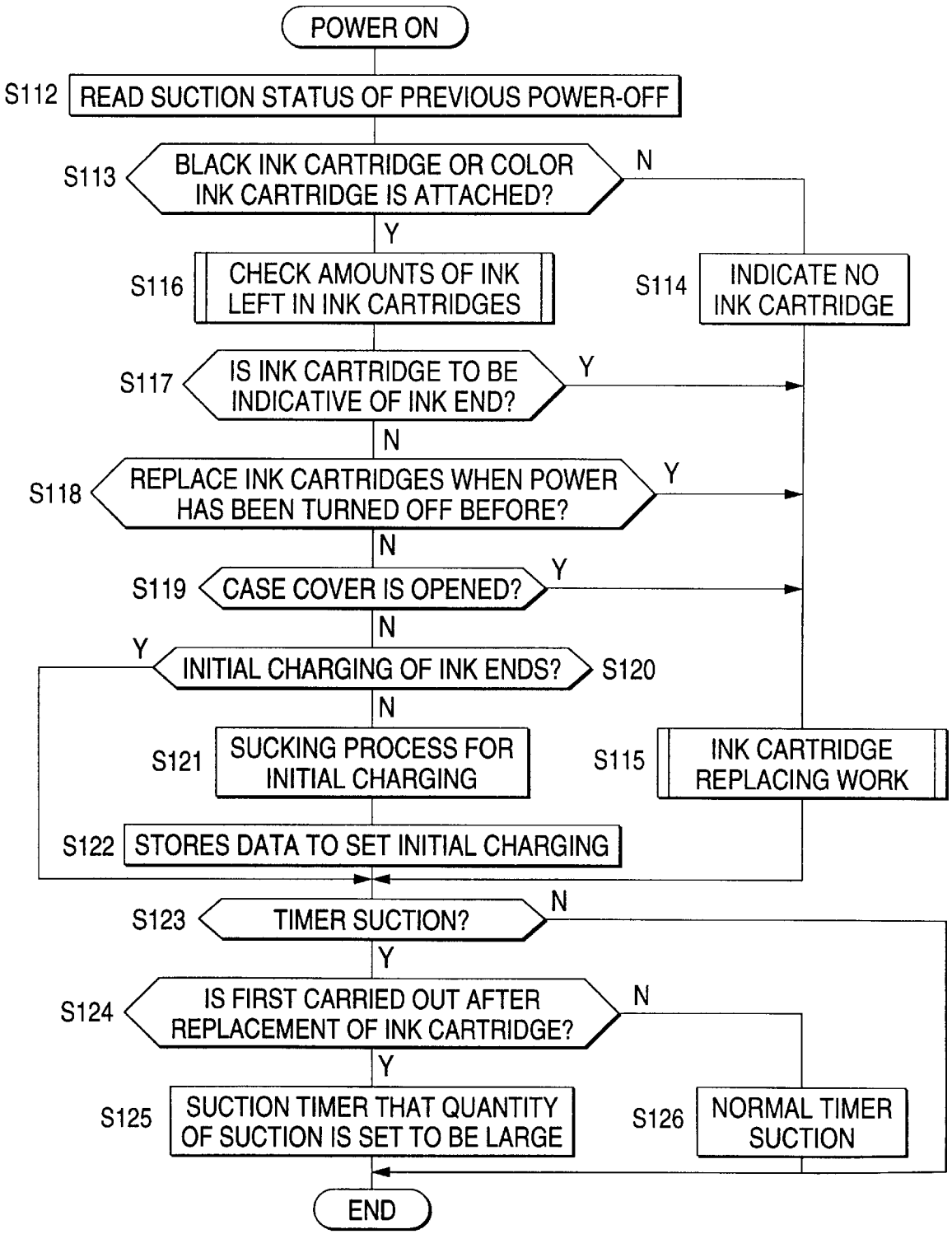
FIG. 5 is a flow chart showing a power-on process.
Figure 6:
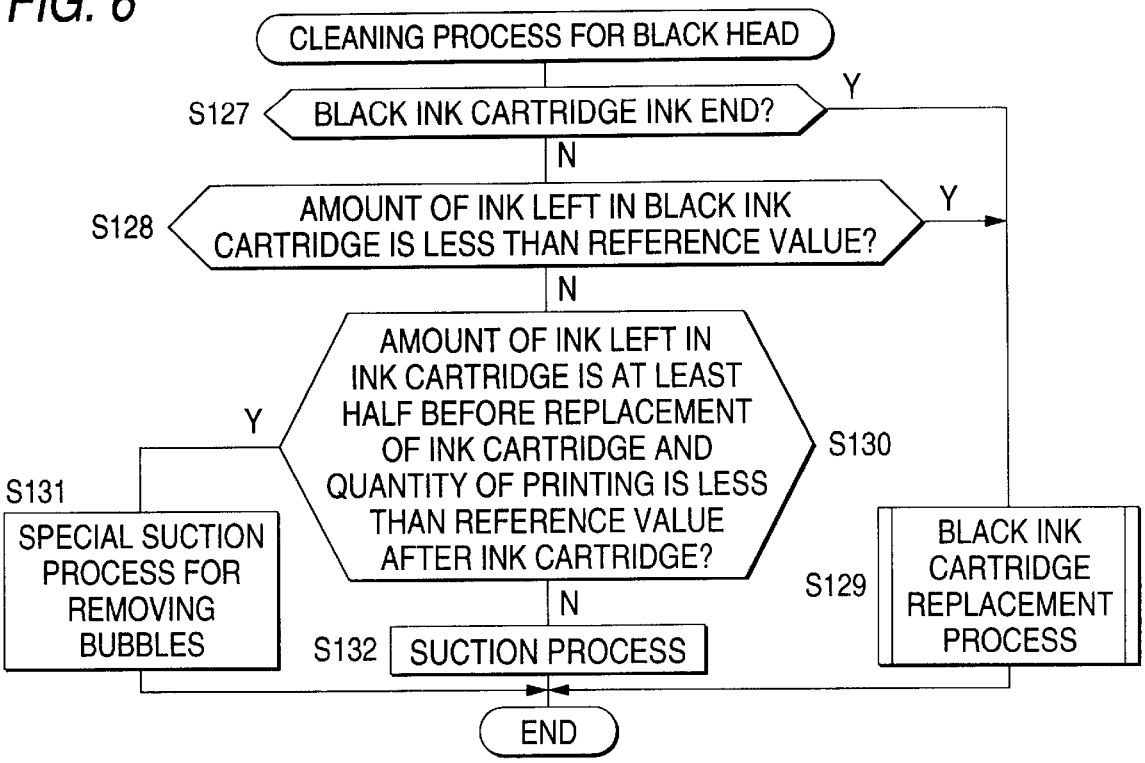
FIG. 6 is a flow chart showing a cleaning process for a black print head.
Figure 7:
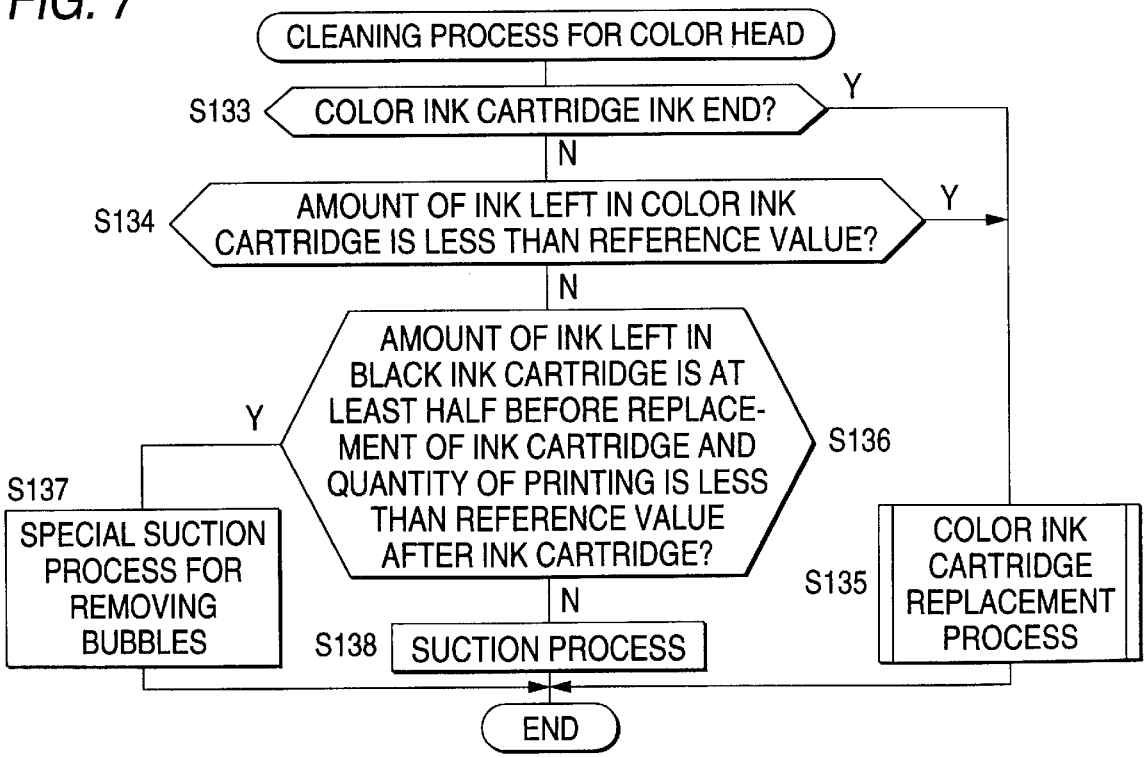
FIG. 7 is a flow chart showing a cleaning process for a color print head.

To be more specific, as shown in FIG. 5, the sequence select means 45 reads a suction status of the previous power-off from the suction status storing means 46 (step S112). Further, it judges whether or not the black ink cartridge 7 or the color ink cartridge 8 is attached to the carriage on the basis of the signal from the ink cartridge replacement judging means 33 (step S113). When neither the black ink cartridge 7 nor the color ink cartridge 8 is attached to the carriage, the sequence select means 45 causes the indicators BE and CB to indicate no ink cartridge (step S114), and starts a sequence of an ink cartridge replacing process to be described later (step S115).

When the black ink cartridge 7 and the color ink cartridge 8 are both attached to the carriage 11, the sequence select means 45 executes a process for checking the amount of ink left in the ink cartridges 7 and 8 on the basis of the data from the ink level detecting means 41 (step S116).

If the amount of ink left in one of the ink cartridges 7 and 8 is extremely small so as to be indicative of an ink end (step S117), the sequence select means 45 starts a sequence of the cartridge replacing process (step S115).

When sufficient amounts of ink are left in the ink cartridges 7 and 8, the sequence select means 45 judges the ending of the cartridge replacing work of the ink cartridges 7 and 8 on the basis of the data stored in the suction status storing means 46. To be more specific, when the power switch P has been turned off before the ink cartridges 7 and 8 have been replaced in a faultless manner (step S114), the sequence select means 45 starts again the ink cartridge replacing work (step S115) or executes the suction process after the replacement of the ink cartridges 7 and 8.

When the cartridge replacing work ends in a faultless manner, the sequence select means 45 checks if the case cover 1 is opened on the basis of the signal from the case opening detecting means 43 (step S119). When the case cover 1 is opened, the sequence select means 45 carries out the cartridge replacing process (step S115). As a result, the sequence of the cartridge replacing process is automatically read out by opening the case cover 1 immediately after the power on or turning on the power switch P after the case cover 1 is opened.

The sequence select means 45 judges whether or not the initial charging of ink ends on the basis of the data from the suction status storing means 46 (step S120). If it does not end, i.e., the ink has never been charged into the print heads 17 and 18, the sequence select means 45 executes the sucking process for the initial charging (step S121), and stores the data to set the initial charging flag to an on state in the suction status storing means 46 (S122), to thereby prevent the initial charging operation consuming a large mount of ink from being mistakenly performed.

In a state that the attaching of the ink cartridges 7 and 8 is completed, when a timer suction process, which is for removing the orifice clogging, which is possibly caused when the printer is not used for a long time, starts (S123), the sequence select means 45 executes the suction timer process in a manner that a quantity of suction is set to be relatively large (S125) when the timer suction process is first carried out after the replacement of the ink cartridges 7 and 8 (S124), and it is set to be relatively small when the suction timer process has already been carried out (S126).

With this process, of the air bubbles having entered into the print heads 17 and 18 through the replacing operation of the ink cartridges 7 and 8, the bubbles that are still left after the sucking operation performed at the time of cartridge replacement and which subsequently grow are completely removed. Therefore, the suction quantity required merely for the clogging prevention or removal is minimized, to thereby save the ink.

When the power on process ends, the sequence select means 45 detects operation states of the switches on the operation panel 9. If the cleaning instruction switches BC and CC are operated (S101 and S103 in FIG. 4), the sequence select means 45 carries out a cleaning process for the black ink print head 17 and another cleaning process for the color ink print head 18 (S102 and S104), both processes being described later. When the ink cartridge replacement switch IC is operated (S105), the sequence select means 45 starts a sequence of a cartridge replacing process to be described later (S106).

When the supply of electric power still continues (S107) after the processes corresponding to the operations instructed by the switches on the operation panel 9, the sequence select means 45 waits for the incoming print data from the host computer (S109). When any of the switches on the operation panel 9 is depressed, the sequence select means 45 executes the steps S101 to S106. When the printer, which is in a ready-for-printing state, receives print data, the sequence select means 45 checks the amount of ink left in the ink cartridges 7 and 8 (S111) while executing a printing process to be described later (S110), and returns to the first step S101.

B. Cleaning Process for the Black Ink Print Head

When the black head cleaning instruction switch EC for the black ink print head 17 is operated on the operation panel 9, the sequence select means 45 checks the amount of the ink left in the black ink cartridge 7 on the basis of the data from the sequence select means 45. If the black ink cartridge 7 is in an ink end state (S127 in FIG. 6), the sequence select means 45 starts the sequence of the replacing process for the black ink cartridge 7 (S129), and blinks the ink end indicator BE to indicate the ink end.

When the amount of the residual ink in the black ink cartridge 7 is enough to print but less than a predetermined value of the ink amount, i.e., an amount of the ink that will be consumed by the ink suction during cleaning so as to be insufficient for the printing (S128), the sequence select means 45 starts the sequence of the replacing process for the black ink cartridge 7 in order to eliminate an unwanted situation in which, as the result of discharging of the ink, air bubbles enter the black ink cartridge 7 (S129).

When the amount of the ink left in the black ink cartridge 7 is at least half of the ink amount before the replacement of the ink cartridge and a quantity of printing is less than a reference value after the ink cartridge is replaced (S130), the sequence select means 45 executes a special suction process for removing the bubbles entered at the time of the cartridge replacement (S131). In the special suction process for bubble discharging, the sequence select means 45 resets the residual ink amount in the ink level detecting means 41, switches a one-time flag to an on state, and executes a suction process as executed after the ink cartridge replacement. For a cleaning instruction by the user when a predetermined quantity of printing, e.g., five (5) pages or larger, has been made after the ink cartridge replacement, the sequence select means 45 sets the one time flag to an off state, and executes a normal suction process consuming a smaller amount of auction ink. For a cleaning instruction when the quantity of the printing in less than the predetermined quantity, the sequence select means 45 sets the one time flag to an on state and executes the special suction process for bubble removal.

When the amount of the ink left in the black ink cartridge 7 is large and enough ink will be left after the cleaning, or when a new black ink cartridge 7 is attached, the sequence select means 45 moves the black ink print head 17 to its home position, caps it with the capping unit 19, and causes the suction control means 39 to control the auction pump 23*a* so as to suck the ink from the black ink print head 17 for its discharging (S123).

C. Cleaning Process for the Color Ink Print Head

When the color head cleaning instruction switch CC for the color ink print head 18 is operated on the operation panel 9, the sequence select means 45 checks the amount of ink left in the color ink cartridge 8 on the basis of the data from the sequence select means 45. If the residual ink level is an ink end level (S133 in FIG. 7), the sequence select means 45 starts the sequence of the replacing process for the color ink cartridge 8 (S135).

When the amount of the residual ink in the color ink cartridge 8 is enough to print but less than a predetermined value of the ink amount, e.g., in a near end level, i.e., an amount of the ink that will be consumed by the ink suction during cleaning so as to be insufficient for the printing (S134), the sequence select means 45 starts the sequence of the replacing process for the color ink cartridge 8 in order to eliminate an unwanted situation in which, as the result of discharging of the ink, air bubbles enter the color ink cartridge (S137).

In the special bubble removal suction process, the sequence select means 45 resets the residual ink amount in the ink level detecting means 41, switches a one-time flag to an on state, and executes a suction process as executed after the ink cartridge replacement. For a cleaning instruction by the user when a predetermined quantity of printing, e.g., five (5) pages or larger, has been made after the ink cartridge replacement, the sequence select means 45 sets the one time flag to an off state, and executes a normal suction process consuming a smaller amount of suction ink. For a cleaning instruction when the quantity of the printing is less than the predetermined quantity, the sequence select means 45 sets the one time flag to an on state and executes the special suction process for bubble removal.

When the amount of the ink left in the color ink cartridge 8 is large and enough ink to print will be left after the cleaning, or when a new color ink cartridge 8 is attached, the sequence select means 45 moves the color ink print head 18 to its home position, caps it with the capping unit 19, and causes the suction control means 39 to control the suction pump 23*a* so as to suck the ink from the black ink print head 17 for its discharging (S138).

When the suction process is completed, the sequence select means 45 causes the cleaning unit 24 to rub the nozzle plates, if required, and moves the print heads 17 and 18 to the capping unit 19, and causes the print/flushing control means 37 to perform a flushing operation.

D. Detection of the Amount of Residual Inks

Figure 8:
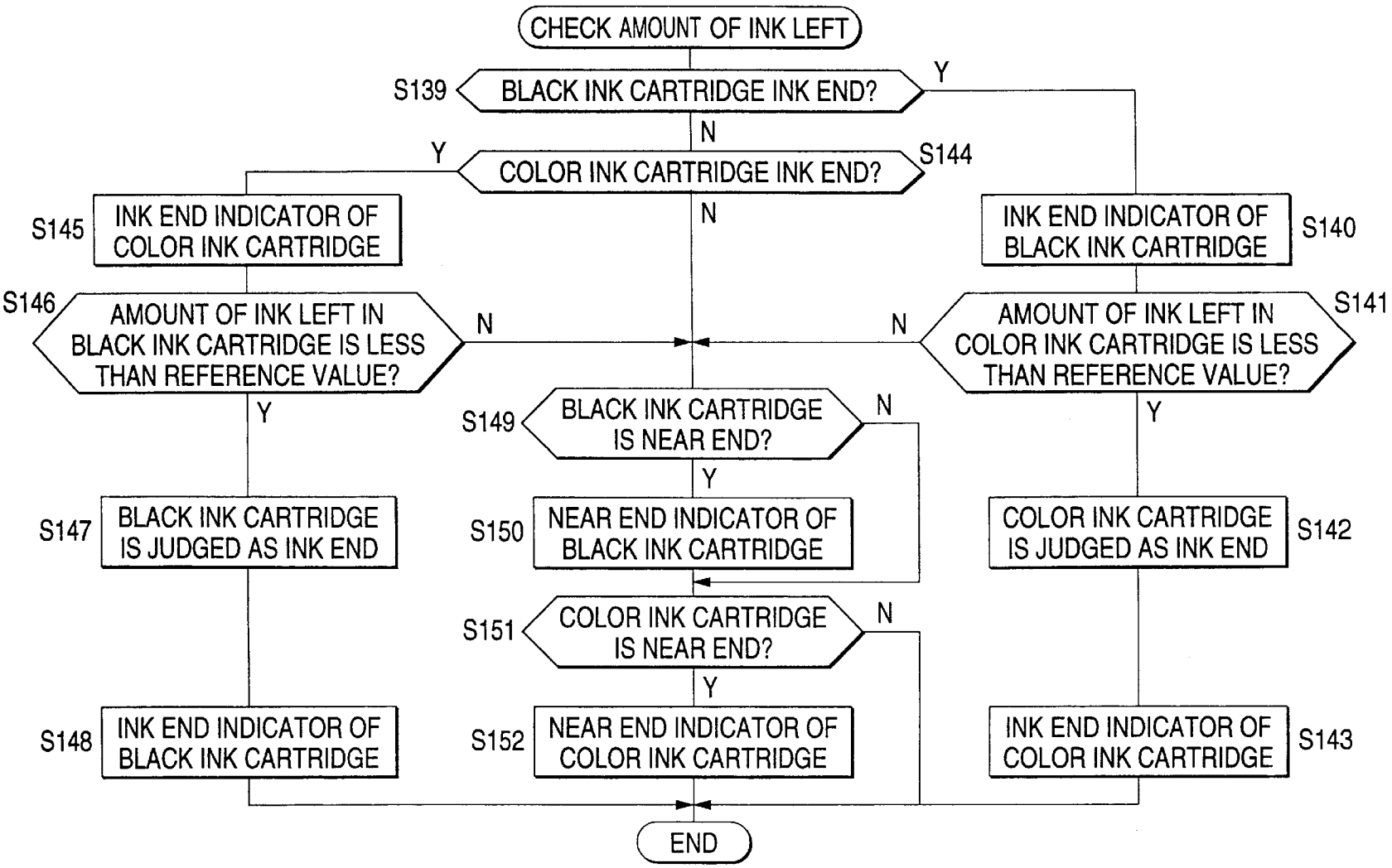
FIG. 8 is a flow chart showing an operation for checking the amount of ink left in the cartridges.
Figure 9:
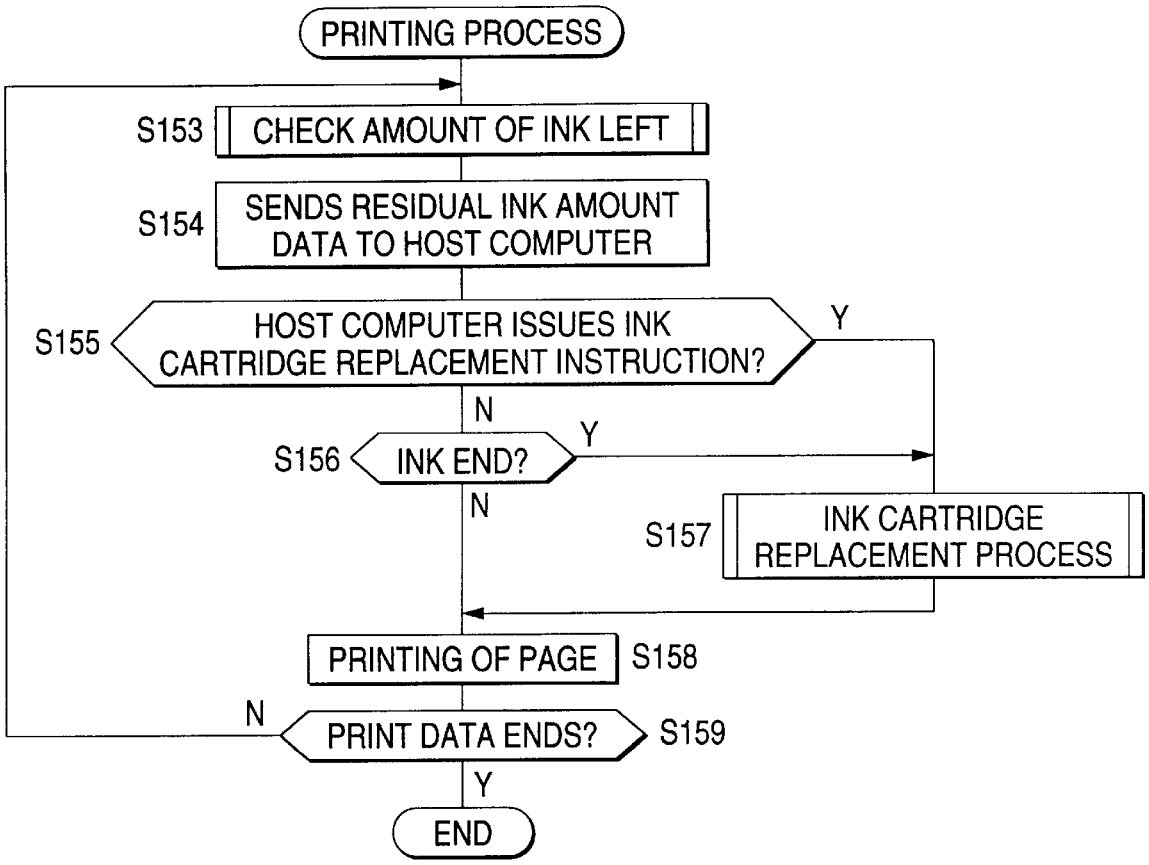
FIG. 9 is a flow chart showing a printing process.

When a time to check the amount of residual ink is reached, the sequence select means 45 judges whether or not the amount of the ink left in one of the ink cartridges, e.g., the black ink cartridge 7, is at an ink end level on the basis of the data from the ink level detecting means 41 (S139 in FIG. 8). If it is at an ink end, the sequence select means 45 causes the ink end indicator BE to blink to indicate a black ink end (S140). Subsequently, the sequence select means 45 checks the amount of the ink left in the other ink cartridge, i.e., the color ink cartridge 8 in this embodiment. If the result shows that it is not at the ink end level, but not less than an amount of the ink that will be consumed by the ink suction in the cleaning (S141), the sequence select means 45 judges that the amount of the residual ink is at an ink end level (S142), and causes the ink end indicator CE for the color ink cartridge 8 to blink to indicate the ink end (S143).

When a sufficient amount of ink is left in the black ink cartridge 7 which was first checked for its ink amount left therein, the sequence select means 45 repeats a sequence of the steps similar to the above-mentioned one for the color ink cartridge 8 (S144 to S148). That is, the sequence select means 45 checks if the amount of the ink left in the color ink cartridge 8 is in at ink end level, and if it is at the ink end level, the sequence select means 45 causes the ink end indicator CE to blink (S145). Subsequently, the sequence select means 45 also checks the amount of the ink left in the black ink cartridge 7. If it is not at the ink end level, but is extremely small and not less than an amount of the ink that will be consumed by the ink suction in the cleaning (S146), the sequence select means 45 judges that the amount of the residual ink is at an ink end level (S147). and causes the black ink end indicator BE for the black ink cartridge 7 to blink to indicate the ink end (S148).

Figure 15:
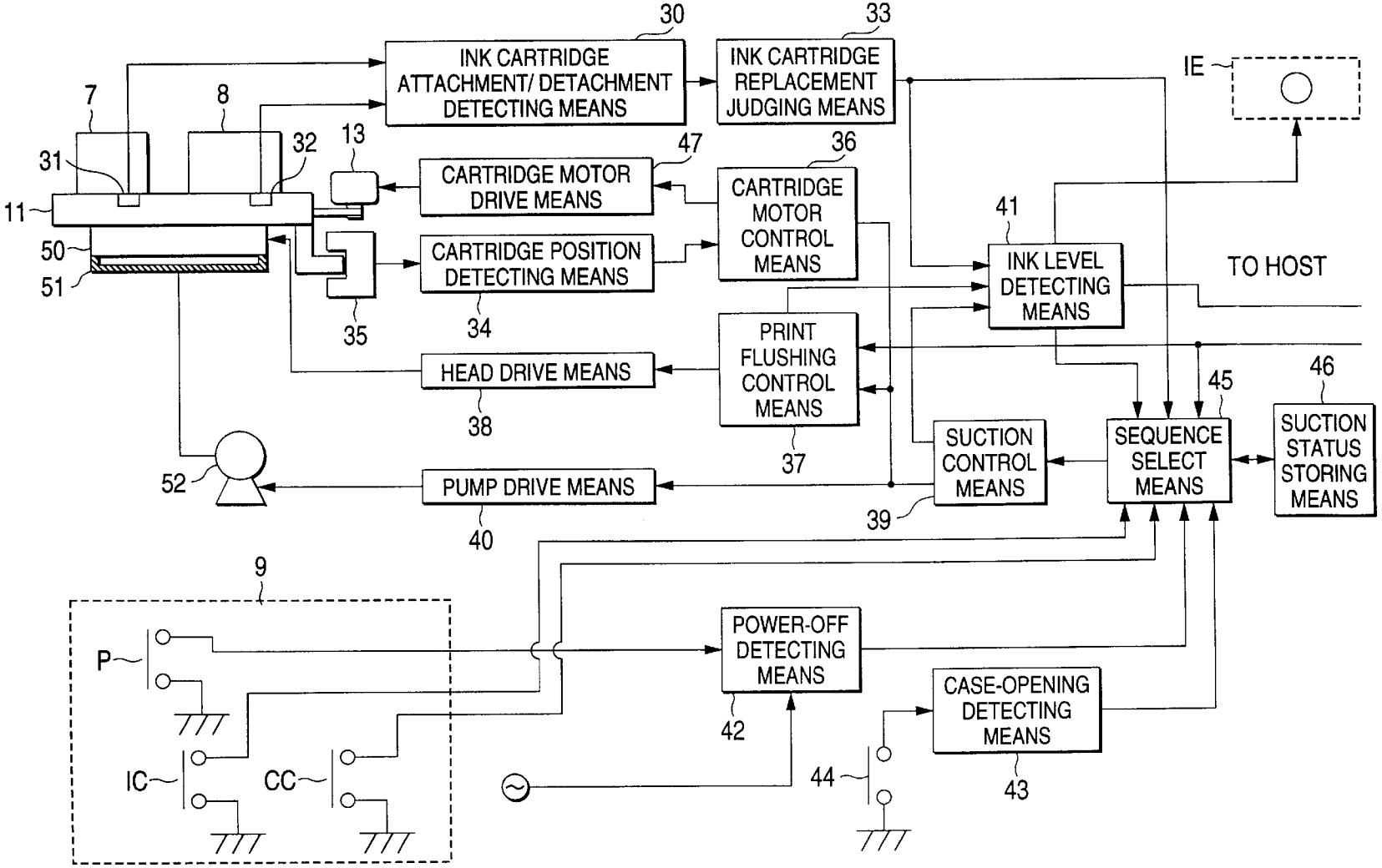
FIG. 15 is a block diagram showing an ink jet printer according another embodiment of the present invention.

When the amount of the ink left in one of the ink cartridges is reduced to such an extent as to require the replacement of the ink cartridge with a new one, the sequence select means 45 checks the amount of the ink left in the other ink cartridge as well as that in the first ink cartridge. If the result shows that the residual ink amount is enough to print but less than a predetermined value of ink amount necessary for the suction operation, the sequence select means 45 judges that the residual ink amount is at the ink end level. This creates an advantage in a printer with the print heads constructed as shown in FIG. 15. As shown, in the FIG. 15 print heads, a single nozzle plate is used commonly to both the print heads, and therefore it is impossible to independently seal the orifice arrays of different inks. That is, the print heads are sealed with a single cap 51. In this type of the print heads, ink is sucked from the ink cartridge containing a sufficient amount of ink therein as well as the ink cartridge whose residual ink is at the ink end level. In other words, the ink is wastefully used. There is a chance that when one of the ink cartridges is replaced with a new one, the ink left in the other ink cartridge has been almost completely consumed and is at a near end level. An additional replacement of the ink cartridge must be done in the immediate future.

If the sequence select means, upon the above judgement, calls upon the user to replace one ink cartridge and the other ink cartridge as well, a single suction operation will suffice for both ink cartridges. The result is the simplification of the replacing work of the ink cartridges and the lessening of the ink consumption.

When it is confirmed that the amount of ink left in the two ink cartridges 7 and 8 is greater than an ink quantity which leads to the judgment of the ink end, the ink level detecting means 41 judges whether or not the amount of the ink in the black ink cartridge 7 is at the near end level (S149). If it is at the near end level, the sequence select means causes the ink end indicator BE to blink, to thereby inform the user that the residual ink amount of the black ink cartridge 7 is at the near end level (S150).

When a sufficient amount of ink is left in the black ink cartridge 7, the sequence select means judges whether or not the amount of ink in the color ink cartridge 8 is at the near end level (S151). If it is at the near end level, the sequence select means causes the ink end indicator CE to blink to inform the user that the ink left in the color ink cartridge 8 is at the near end level (S152).

E. Printing Process

When print data is received and the printer is ready for printing, the sequence select means 45 checks the amount of ink left in the ink cartridges 7 and 8 on the basis of the data from the ink level detecting means 41 (S153 in FIG. 9), and if necessary, sends the residual ink amount data to the host computer (S154).

The host computer computes the amount of ink necessary for the print data to be used for the printing, and compares the necessary ink amounts with the residual ink amount data received. If the amount of ink left in the ink cartridges 7 and 8 is less than the necessary amount of ink, the host computer issues a cartridge replacement instruction (S155), or displays an error on the display means of the host computer to urge the user to continue the printing operation or to make the replacement of the ink cartridge or cartridges. If the user chooses the ink cartridge replacement, the host computer sends a cartridge replacement instruction to the printer. Upon receipt of the instruction, the sequence select means 45 starts the sequence of the ink cartridge replacement process (S157). When the data from the ink level detecting means 41 shows that the ink in the cartridges is at the ink end level (S156), the sequence select means 45 starts the sequence of the ink cartridge replacement process (S157).

When the printer passes the check of the residual ink amounts of the ink cartridges 7 and 8, or when the ink cartridges 7 and 8 are replaced with new ones and the printer is ready for printing, the sequence select means 45 transfers the print data received from the host computer to the print/flushing control means 37, whereby the printing of one page is performed (S158). When the print data of two or more pages is present, the sequence select means executes the process steps (S153 to S158) and the printing of the next and subsequent pages is carried out (S159).

Figure 4:
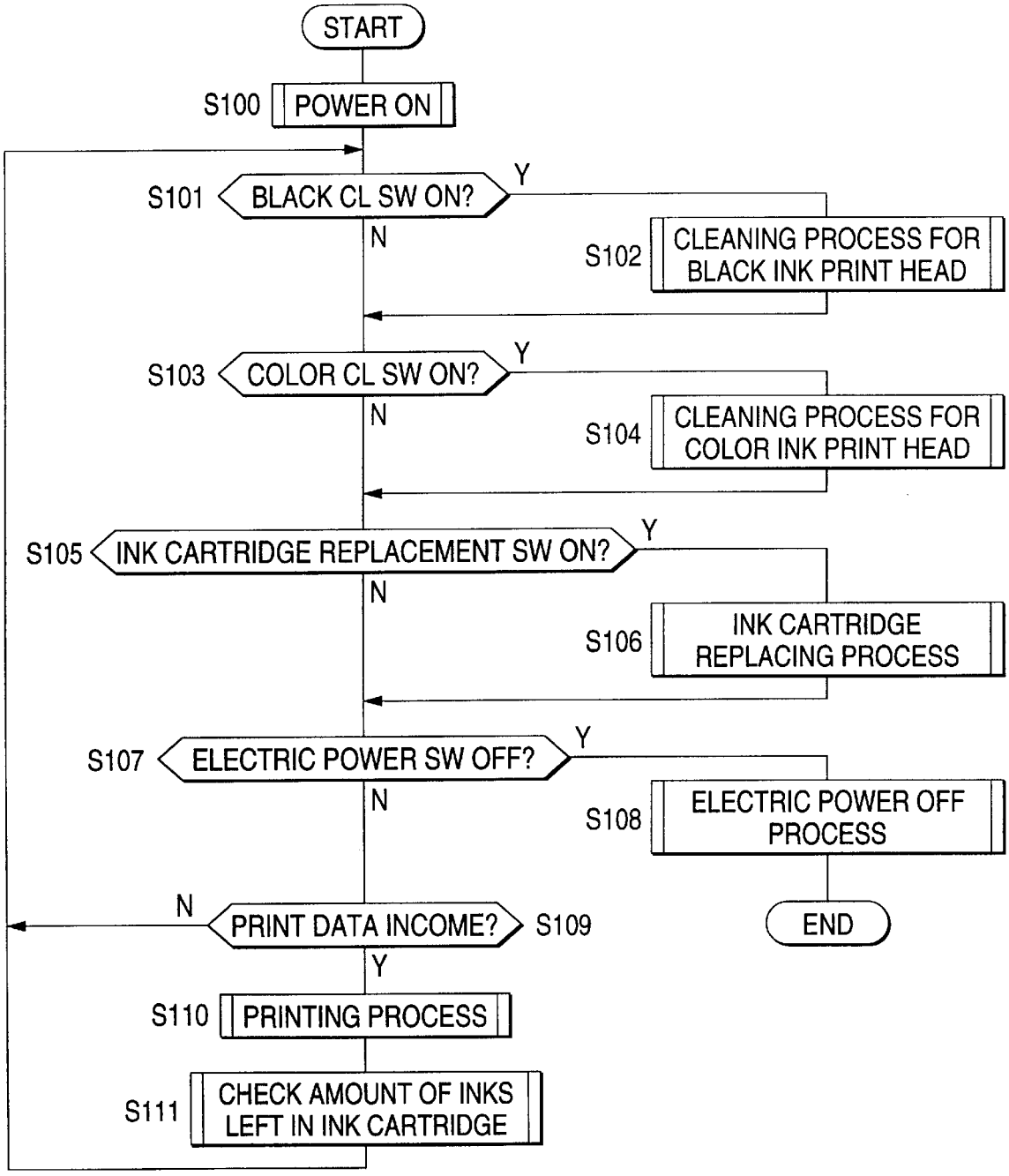
FIG. 4 is a flow chart showing an overall operation of the printer.

Eventually, the printing operation ends, and the user gives an off instruction to the printer by use of the power switch P (S107 in FIG. 4). The power-off detecting means 42 outputs a signal, and the sequence select means 45 executes the power-off process (S108).

P. Power-Off Process

Figure 10:
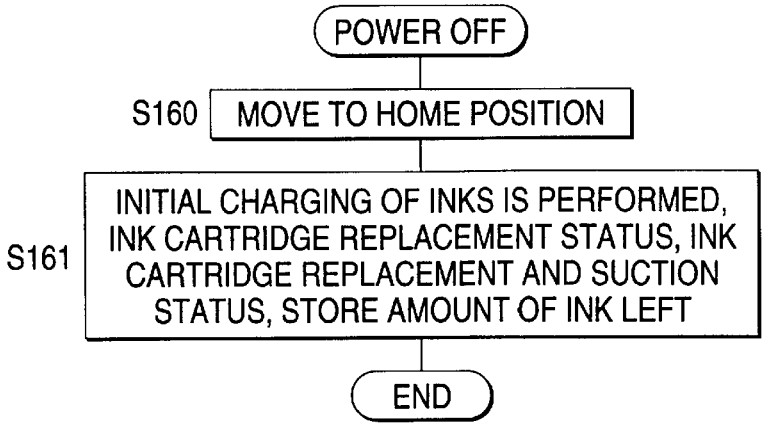
FIG. 10 is a flow chart showing a power-off process.

When the power switch P is turned off and the power-off detecting means 42 produces a signal, the sequence select means 45 drives the carriage motor control means 36 which in turn moves the case cover 1 to the home position (S160 in FIG. 10). As a result, the print heads 17 and 18 are capped with the caps 20 and 21, to thereby prevent the ink in the discharge orifices of the print heads 17 and 18 from drying out.

In a case where the present operation of the printer is the first time operation after the ink cartridges are first attached to the carriage, and the initial charging of ink is performed, the sequence select means judges whether or not the initial charging operation has been performed in a faultless manner. If it has been performed faultlessly, the sequence select means changes a state of the initial charging flag from an off state to an on state. In a case where the initial charging operation has been completed and the ink cartridges 7 and 8 are replaced with new ones for the purpose of merely supplying the ink, data indicative of the replacement of the ink cartridges, data indicating as to whether or not the suction process following the ink cartridge replacement in faultlessly completed, and residual ink amount data from the ink level detecting means 41 are stored into the auction status storing means 46 (S161). After all the data indicating the present status are stored, the supply of electric power to the printer is stopped.

G. Ink Cartridge Replacing Process

Figure 11:
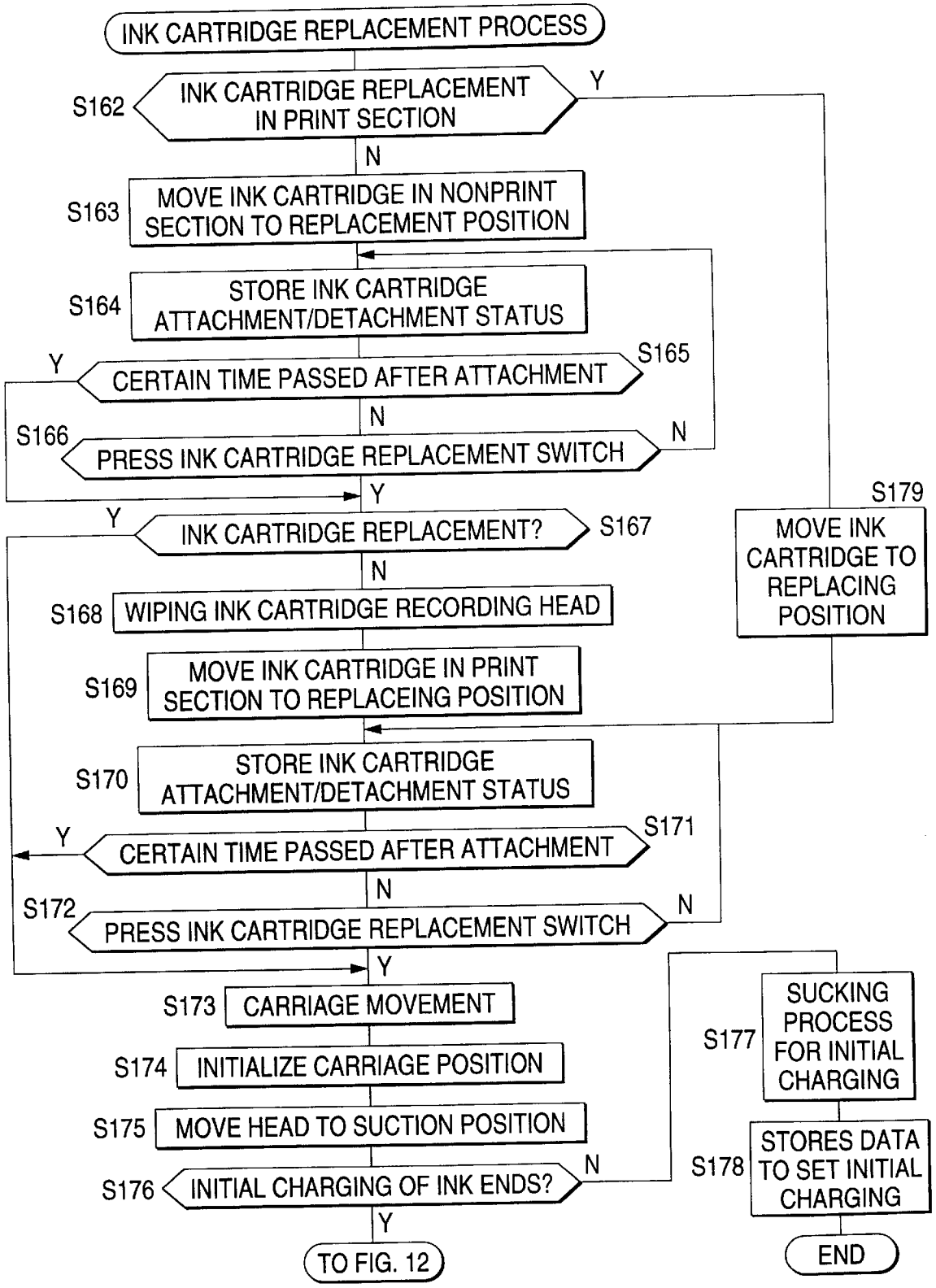
FIG. 11 is a flow chart showing the first half of a cartridge replacing process.
Figure 12:
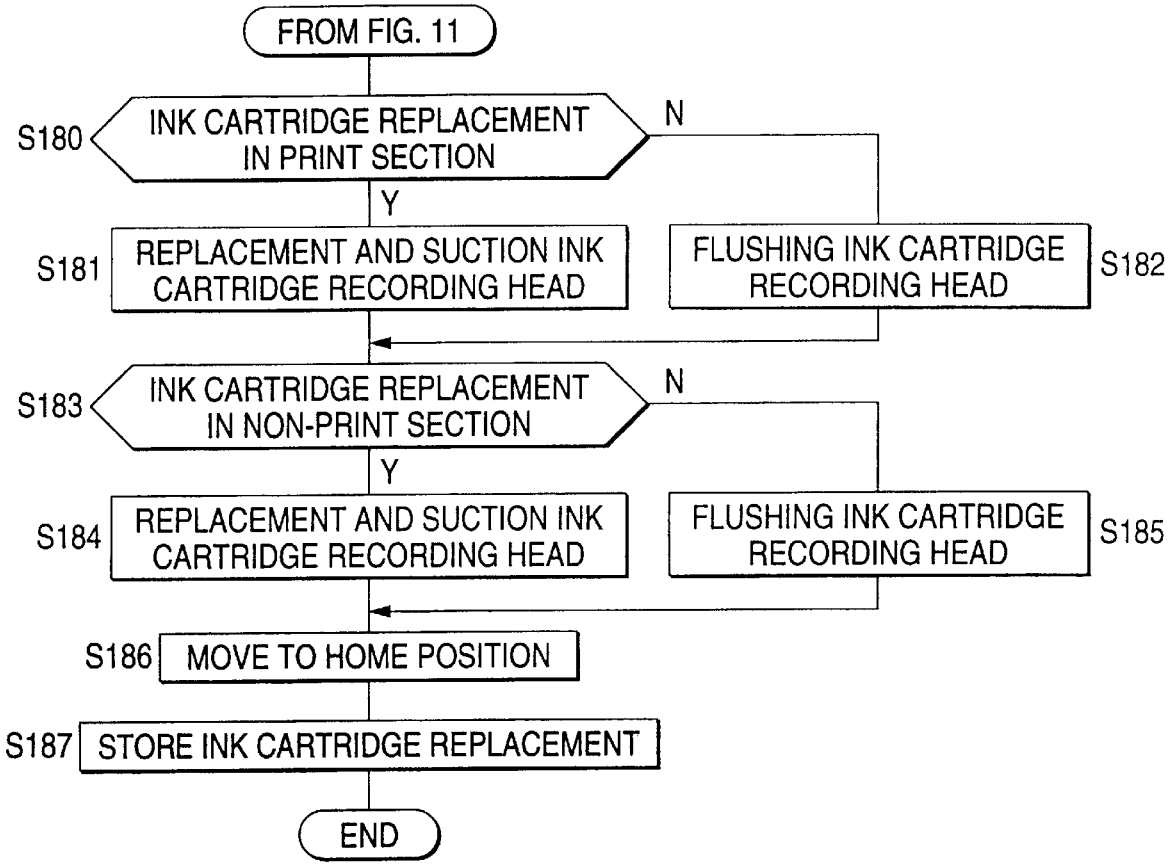
FIG. 12 is a flow chart showing the second half of a cartridge replacing process.

When the ink cartridge replacement switch IC on the operation panel 9 is operated or the sequence of the cartridge replacing process is started through the execution of the above-mentioned process steps the sequence select means 45 judges whether, of the two ink cartridges 7 and 8, which are arranged side by side in the moving direction of the carriage 11, only the ink cartridge 7 disposed in the print section of the printer case body is to be replaced or both the ink cartridges 7 and 8 are to be replaced (S162 and S163 in FIG. 11).

Figure 13:
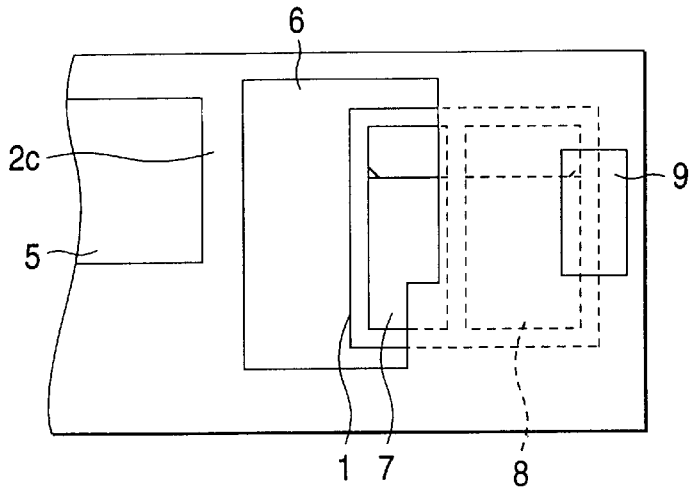
FIGS. 13(*a*) to 13(*c*) are diagrams showing states of the head-cartridge-carriage portion in the printer when the carriage is moved to the home position, a replacing position for the color ink cartridge, and a replacing position for the black ink cartridge, respectively.
Figure 13:
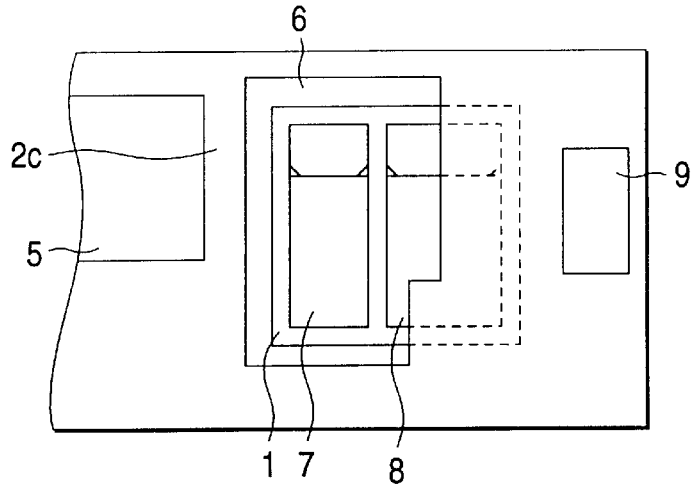
Figure 13:
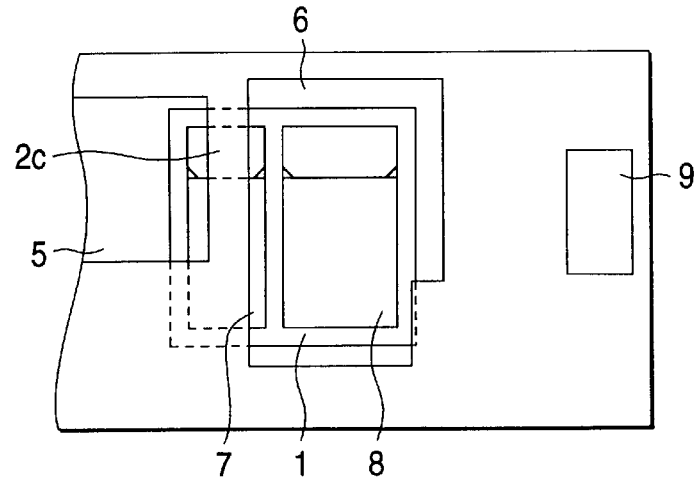
Figure 14:
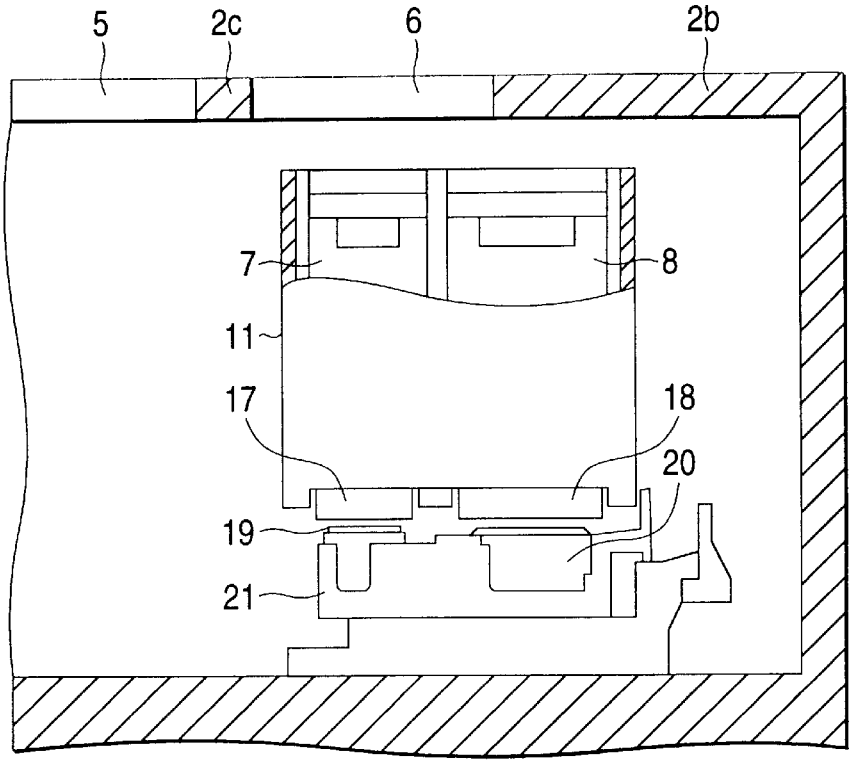
FIGS. 14(*a*) and 14(*b*) are diagrams showing positional relationships between the print heads and the capping unit when the carriage is moved to the replacing positions for the color and black ink cartridges, respectively.
Figure 14:
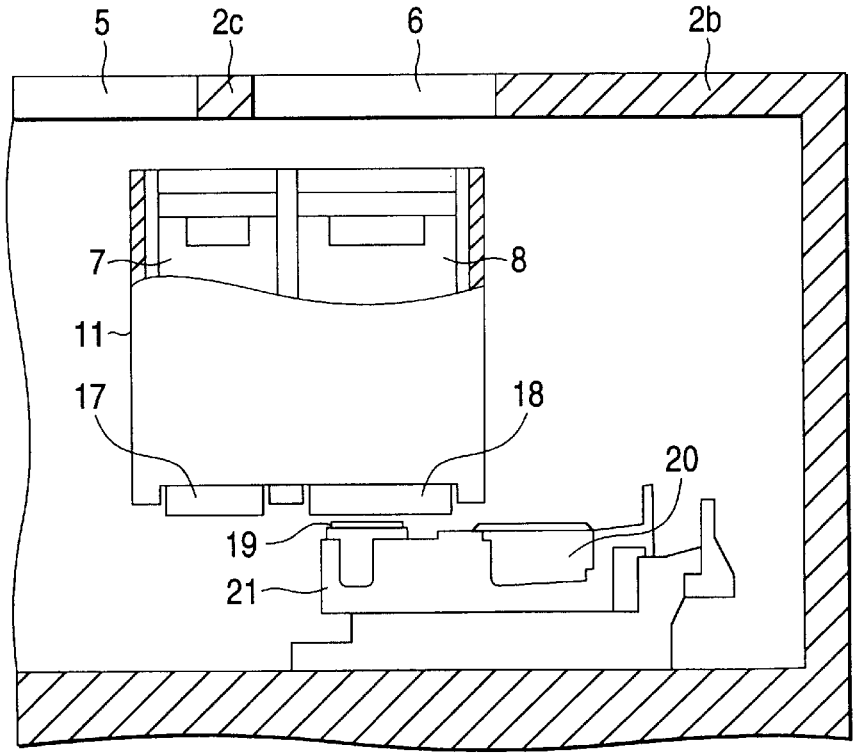

When both the ink cartridges 7 and 8 are to be replaced, the sequence select means 45 causes the carriage motor control means 36 to move the carriage 11, which is at the home position (FIG. 13(*a*)), to the print section, whereby the color ink cartridge 8 attached to the portion of the carriage 11 located in the nonprint section is moved to the replacing position, i.e., the position confronted with or right under the window 6 (FIG. 13(*c*), FIG. 14(*b*)).

In this state, only the color ink cartridge 8 is confronted with the window 6, and the black ink cartridge 7 is confronted with the partitioning portion 2*c*. This state of the printer allows the user to detach only the color ink cartridge 8 from the carriage. Therefore, it is easy to specify the ink cartridge to be replaced, including the black ink cartridge 7, and hence there is no chance that the user mistakenly pulls out another ink cartridge, i.e., the ink cartridge that does not need to be replaced.

When the color ink cartridge 8 in the window 6 is pulled out, the switch or detector 32 detects the pulling-out of the color ink cartridge 8 and produces a signal indicative of that. When a new ink cartridge 9 is attached to the carriage 11, the same detector detects the attachment of the ink cartridge and produces a signal indicative of that. In response to this signal, the sequence select means 45 stores the replacement of the ink cartridge 8 into the suction control means 39 (S164).

When the user presses the ink cartridge replacement switch IC (S166) within a preset time after the attaching of the new color ink cartridge 8, or after the preset time elapses, judgement is automatically made as to if only one cartridge is to be replaced (S167).

In the present case, two ink cartridges 7 and 8 are to be replaced. Therefore, the sequence select means 45 outputs a signal to the carriage motor control means 36 to move the print head 18 now coupled with the new color ink cartridge 8 to the wiping position where the nozzle plate of the print head is wiped with the cleaning unit 24 (S168). As the result of the attaching/detaching of the color ink cartridge 8, ink frequently oozes out of the discharge orifices. However, this ink is wiped out through the wiping operation, to thereby prevent the ink from dropping.

When the replacement of the color ink cartridge 8 located in the nonprint section is completed, the sequence select means 45 causes the carriage motor control means 36 to move the carriage 11. With the movement of the carriage, the black ink cartridge 7 is moved to the cartridge replacing position, i.e., the position confronted with the window 6 (S169) (FIG. 13(*b*), FIG. 14(*a*)). As the result of this movement, the print head 18 having undergone the first replacement of the color ink cartridge 8 is retracted to the home position. Therefore, if the ink drops due to the replacement of the color ink cartridge 8, the print section is not soiled with the dropped ink.

When the ink cartridge 7 is pulled out for replacement, the switch or detector 32 detects the pulling-out of the ink cartridge 7 and produces a signal indicative of that. When a new ink cartridge 7 is attached to the carriage 11, the same detector detects the attachment of the ink cartridge and produces a signal indicative of that. In response to this signal, the sequence select means 45 stores the replacement of the ink cartridge 7 into the suction control means 39 (S170).

When the user presses the ink cartridge replacement switch IC (S172) within a preset time (S171) after a new ink cartridge is attached to the carriage, or after the preset time elapses, the sequence select means 45 causes the carriage motor control means 36 to drive the carriage drive motor 13 to turn by a low torque or at such a low speed as to cause the movement of the carriage to be appreciated by the user, or to move the carriage by a low torque and at low speed (S173). In this way, the carriage 11 is initialized (S174).

The user sees the low-torque and low-speed movement of the carriage 11, and understands from this that the printer operation has shifted to the next phase. The user will therefore know to pull his or her fingers away from the case 3. Therefore, the user will never have his finger caught by the machine. If the user's finger is caught by the machine, the carriage drive motor 13 will instantly be stopped since its drive torque is relatively small. Therefore, the carriage 11 is not damaged and the user's finger is not hurt. Further, even if an external force acts on the carriage 11 in the cartridge replacement work and the carriage 11 is forcibly moved, the carriage 11 can be moved to a position suitable for printing.

Thus, the carriage 11 has been moved to such a position as to avoid the user's finger being caught by the machine, i.e., in this embodiment, the black ink cartridge 7 located in the print section has been moved to a position where the side of the cartridge closer to the nonprint section is out of the area defined by the window 6. If the carriage position detecting means 34 detects the movement of the carriage 11, the carriage motor control means 36 drives the carriage drive motor 13 to turn by a normal torque and at a predetermined speed, to thereby move the print head 18 to such a position as to allow the capping unit 19 to seal the print head 18 (S175).

The sequence select means 45 judges whether or not the initial ink charging operations for the print head (17, 18) are completed, on the basis of the data of the suction status storing means 46 (S176). In a case where the present attachment of the ink cartridge is a first time attachment after the user procures the printer, i.e., the initial charging flag in the suction status storing means 46 is in an off state, the sequence select means 45 produces a signal for transmission to the suction control means 39 to operate the pump (23*a*, 23*b*). The pump sucks, from the print head (17, 18), an amount of ink necessary for the initial charging, i.e., the amount of ink used for discharging the maintenance liquid, which was charged into the print head (17, 18) at the factory, and for completely removing the air bubbles from the print head to make the print head ready for printing (S177). Then the sequence select means 45 confirms that the initial charging operation is faultlessly completed, and switches the initial charging flag from an off state to an on state, the flag being stored in the suction status storing means 46 (S178).

When the attachment of the ink cartridge (7, 8) is merely for the resupply of the ink (S180, S183 in FIG. 12), the sequence select means 45 sends a signal to the auction control means 39 to operate the pump (23*a*, 23*b*). The pump sucks the amount of ink required when the cartridge replacement is made, from the ink cartridge (17, 18) (S181, S184). The home position is detected by the carriage position detecting means 34, and the carriage 11 is stopped at the home position. The print head (17, 18) is capped by the capping unit 19 (S185), and the fact that the ink is cartridge (7, 8) has been replaced faultlessly is stored in the suction status storing means 46 (S186).

In a case where one ink cartridge is replaced (S162 in FIG. 11), the sequence select means 45 causes the carriage motor control means 36 to move the carriage 11. With the movement of the carriage, the ink cartridge 7 or 8 to be replaced is set at the window 6 position as the replacing position (S179) (FIGS. 13(*b*) and 13(*c*), and FIGS. 14(*a*) and 14(*b*)).

Then, when replacing the ink cartridge (7 or 8), the cartridge is pulled out, and the pulling-out of the cartridge is detected by the detector (31 or 32). When the ink cartridge is attached to the carriage 11, the attachment is detected by the same detector. Therefore, the sequence select means 45 stores the replacement of the ink cartridge (7 or 8) in the suction control means 39 (S170 in FIG. 11).

When the user presses the ink cartridge replacement switch IC (S172) within a preset time (S171) after a new ink cartridge is attached to the carriage, or after the preset time elapses without pressing the switch IC, the sequence select means 45 causes the carriage motor control means 36 to drive the carriage drive motor 13 to turn by a low torque or at such a low speed as to cause the movement of the carriage to be appreciated by the user, or to move the carriage by a low torque and at low speed (S173). In this way, the carriage 11 is initialized (S174).

Thus, the carriage 11 has been moved to such a position an to prevent the user's finger from being caught by the machine, i.e., in this embodiment, the black ink cartridge 7 located in the print section has been moved to a position where the side of the cartridge closer to the nonprint section is out of the area defined by the window 6. If the carriage position detecting means 34 detects the movement of the carriage 11, the carriage motor control means 36 drives the carriage drive motor 13 to turn by a normal torque and at a predetermined speed, to thereby move the print head 18 to such a position as to allow the capping unit 19 to seal the print head 18 (S175).

The sequence select means 45 judges whether or not the initial ink charging operation for the print head (17 or 18) is completed, on the basis of the data of the suction status storing means 46 (S176). In a case where the present attachment of the ink cartridge is the first time attachment after the user procures the printer, i.e., the initial charging flag in the suction status storing means 46 is in an off state, the sequence select means 45 produces a signal for transmission to the suction control means 39 to operate the pump (23*a* or 23*b*). The pump sucks from the print head (17 or 18) an amount of ink necessary for the initial charging, i.e., the amount of ink used for discharging the maintenance liquid, which was charged into the print head (17 or 18) at the factory, and for completely removing the air bubbles from the print head to make the print ready for printing (S177). Then, the sequence select means 45 confirms that the initial charging operation is faultlessly completed, and switches the initial charging flag from an off state to an on state, the flag being stored in the suction status storing means 46 (S178).

When the attachment of the ink cartridge (7 or 8) is for the resupply of ink (S180, S183 in FIG. 12), the sequence select means 45 sends a signal to the suction control means 39 to operate the pump (23*a* or 23*b*). The pump sucks the amount of ink required when the cartridge replacement is made, from the ink cartridge (17 or 18) (S181, S184).

Following the sucking operation, the sequence select means 45 moves the carriage 11 to the flushing position, and causes the print/flushing control means 37 to flush the print head (17 or 18) whose cartridge (7 or 8) is not replaced. By the flushing operation, ink with an increased viscosity is discharged from the print head, to thereby prevent the clogging of the print head orifices, and to repair the broken meniscuses in the discharging orifices (S184, S182).

When those operations end, the home position is detected by the carriage position detecting means 34, and the carriage 11 is stopped at the home position. The print head (17 or 18) is capped by the capping unit 19 (S185), and the fact that the ink cartridge (7 or 8) has been replaced faultlessly is stored in the suction status storing means 46 (S186).

If, during the work of replacing of the ink cartridge (7 or 8), the power switch P is mistakenly turned off, the sequence select means 45 receives a signal from the power-off detecting means 42 to select the power off process (FIG. 10), and stores into the suction status storing means 46, data indicative of the completion of the initial charging operation, cartridge replacement status, and completion of sucking operation resulting from the cartridge replacement, data of the ink level detecting means 41, and the like.

The storage of the data in the suction status storing means 46 provides the following advantage. For example, when the power switch P is mistakenly turned off during the cartridge replacement work, the power on process (FIG. 5) executes again the process interrupted when the power switch P is turned off before the printing operation starts, and sets the print heads 17 and 18 to be ready for printing.

In this embodiment, the carriage 11 is moved to the window 6 position in a priority order of the following cases: 1) it is ascertained that a plural number of ink cartridges are to be replaced; 2) it is detected that the ink cartridge 7, 8 is not attached; 3) it is detected that the amount of ink in the ink cartridge 7, 8 is at an ink end level; 4) it is detected that the amount of ink in the ink cartridge 7, 8 is at a near end level; and 5) it is detected that the ink cartridge 7, 8 contains a sufficient amount of ink for printing. Therefore, the ink cartridge 7, 8 may be replaced in accordance with the indication of the ink end indicator BE, CE. The trouble tending to occur in the replacing work of plural ink cartridges can be avoided.

The present invention can be applied to a print head system of the type in which two print heads 7 and 8 are used, and a single nozzle plate is used for both print heads, so that it is impossible to independently seal the discharging orifice arrays of different color inks. As shown in FIG. 15, a print head 50 is capped with a single cap 51, and a single suction pump 52 is used for the initial ink charging and the suction for the replacement. Further, a single end indicator IE is used.

H. Cleaning Process for the Print Heads

Figure 16:
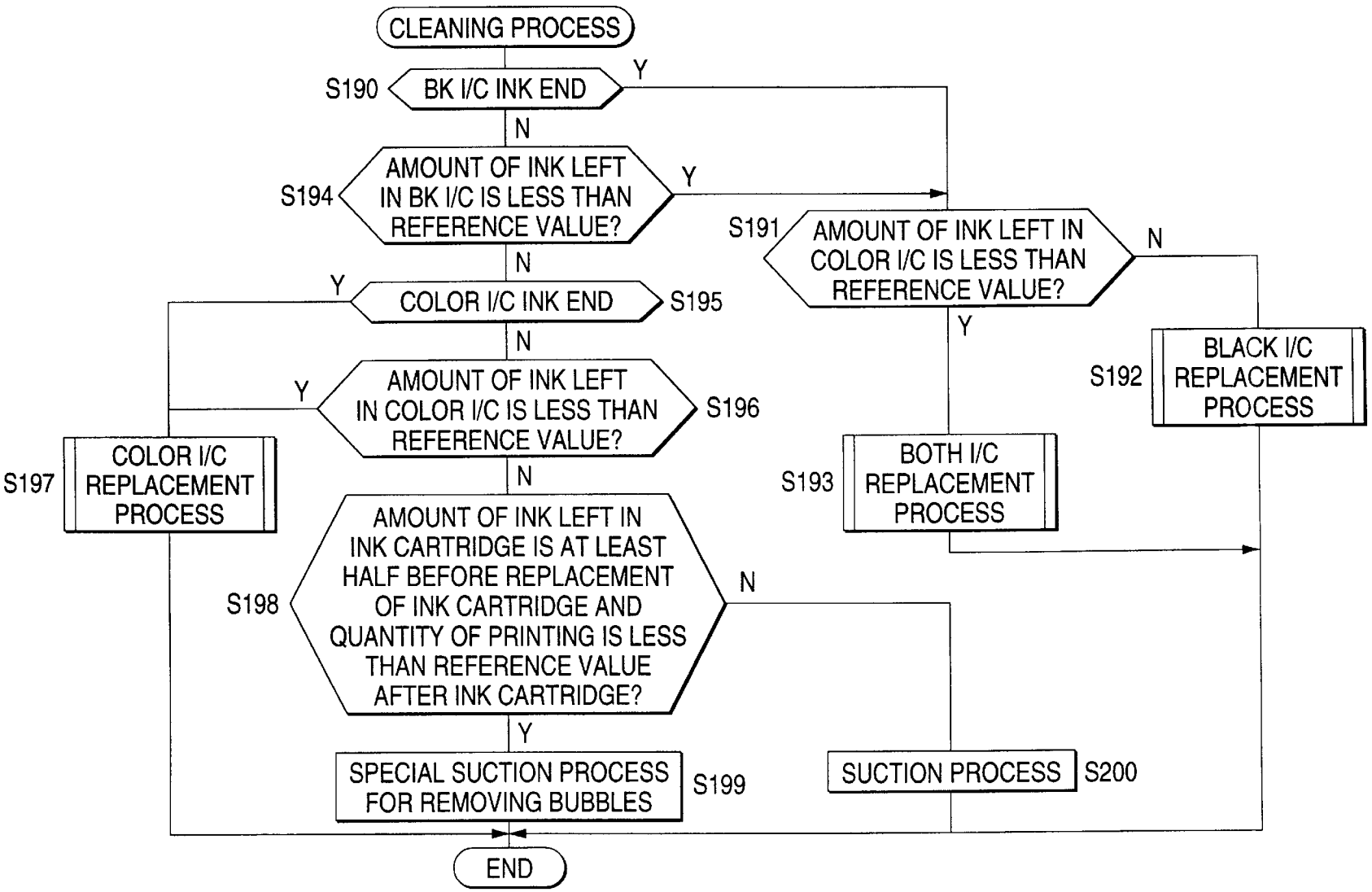
FIG. 16 is a flow chart showing a cleaning process for cleaning the printer.

When the color head cleaning instruction switch CC for the print head 50 is operated on the operation panel 9, the sequence select means 45 checks the amount of ink left in the black ink cartridge 7 on the basis of the data from the ink level detecting means 41. If the ink is at an ink end level (S190 in FIG. 16), the sequence select means 45 checks the amount of ink left in the color ink cartridge 8. If the check result shows that the amount of the residual ink is in excess of the amount of ink consumed by the ink suction in the cleaning operation (S191), the sequence select means 45 starts the process of replacing the black ink cartridge (S192). If the amount of the residual ink is less than the amount of ink consumed by the ink suction in the cleaning operation, the sequence select means 45 starts the process for replacing both ink cartridges 7 and 8 (S193).

When the amount of ink left in the black ink cartridge 7 is greater than the ink amount at the ink end level, but less than the amount of ink consumed by the ink suction in the cleaning operation (S194), the sequence select means 45 checks the amount of the ink left in the color ink cartridge 8. If the check result shows that the residual ink amount is greater than the amount of ink consumed by the ink suction in the cleaning operation (S191), the sequence select means 45 starts the process for replacing the black ink cartridge (S192). If the residual ink amount is leas than the amount of ink consumed by the ink suction in the cleaning operation, the sequence select means 45 starts the process for replacing both the ink cartridges 7 and 8 (S193).

If the residual ink amount of the black ink cartridge 7 is greater than the amount of ink consumed by the ink suction in the cleaning operation (S194), the sequence select means 45 judges that the amount of the ink in the color ink cartridge 8 is at an ink end level (S195), on the basis of the data of the previous residual ink amount check operation for the color ink cartridge 8 (S191). When the residual ink amount is less than the amount of ink consumed by the ink suction in the cleaning operation (S196), the sequence select means 45 starts the process for replacing the color ink cartridge 8 (S197).

In this way, it is ascertained that the amount of ink left in the ink cartridges 7 and 8 in greater than the amount of ink consumed by the ink suction in the cleaning operation. If the sequence select means 45 refers to the data of the ink level detecting means 41 and recognizes that the amount of ink left in the ink cartridges 7 and 8 is at least ½ after the ink cartridges are both replaced, and the amount of printing is less than a predetermined value of the ink amount after the cartridge replacement, the sequence select means 45 executes the special bubble discharging process (S199). If the residual ink amounts and the printing amount are different from those in the above case, the sequence select means 45 executes the suction process (S200).

I. Cartridge Replacement Process

Figure 17:
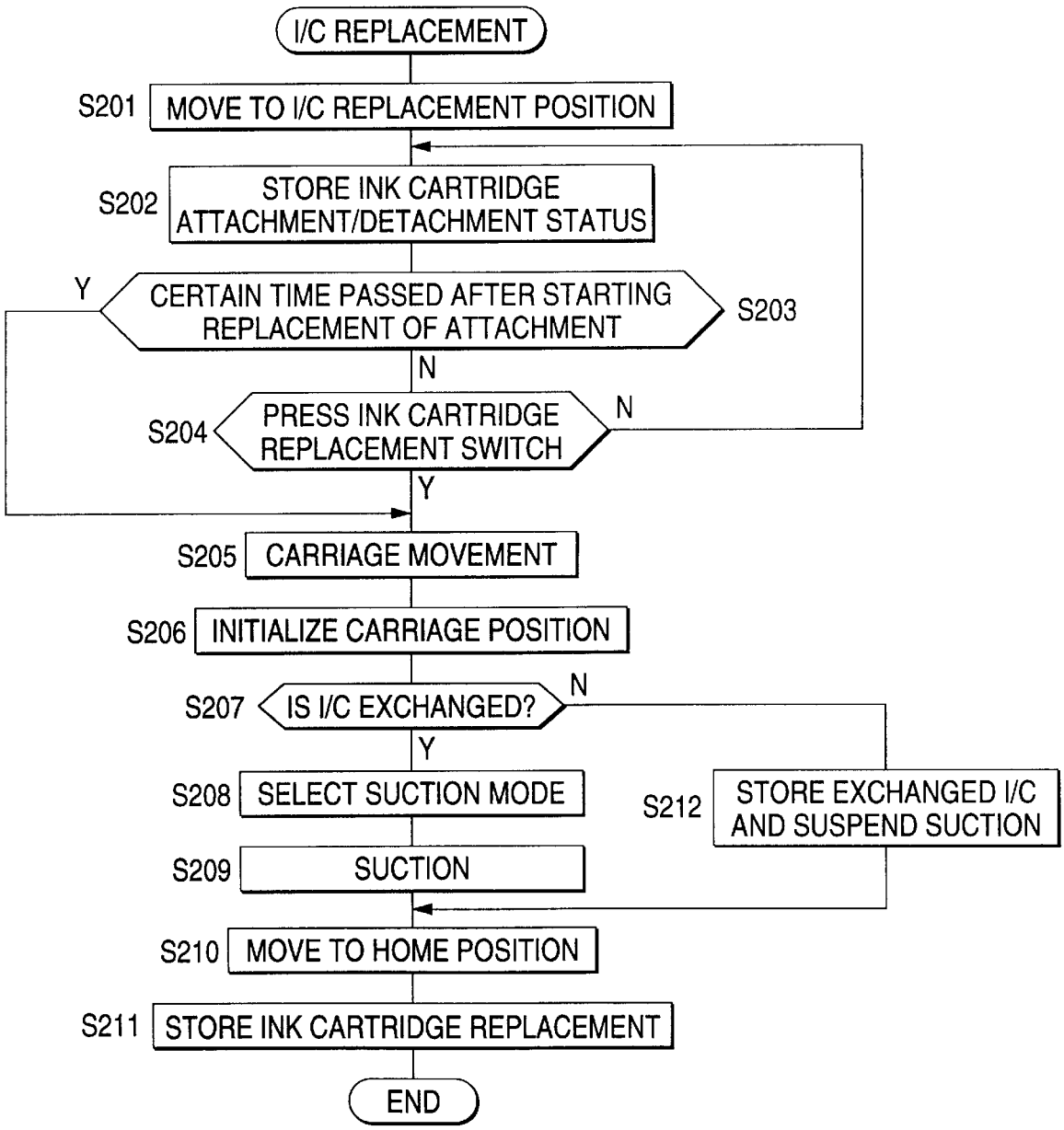
FIG. 17 is a flow chart showing an ink cartridge replacing process used for the FIG. 15 printer.

When the sequence of the ink cartridge replacement process is started by the operating the ink cartridge replacement switch IC on the operation panel 9 or by each process mentioned above, the sequence select means 45 causes the carriage motor control means 36 to move the carriage 11, which is at the home position, to the position for replacing the ink cartridges 7 and 8 in the print section (S201 in FIG. 17).

When the ink cartridge 8 is pulled out, the detector 32 detects the pulling-out of the cartridge, and produces a signal. When the ink cartridge 8 is attached to the carriage 11, the same detector detects the cartridge attachment and produces a signal. Therefore, the sequence select means 45 stores the replacement of the ink cartridge 8 in the suction control means 39 (S202).

When a preset time elapses (S203) after a new color ink cartridge 8 is attached to the carriage, or the user presses the ink cartridge replacement switch IC (S172) within the preset time after the attachment of the new cartridge (S204), the sequence select means 45 causes the carriage motor control means 36 to drive the carriage drive motor 13 to turn by a low torque or at such a low speed as to cause the movement of the carriage to be appreciated by the user, or to move the carriage by a low torque and at low speed (S205). In this way, the sequence select means 45 executes the initializing process of the carriage position (S206). Therefore, even if an external force acts on the carriage 11 in the cartridge replacement work and the carriage 11 is forcibly moved, the carriage 11 can be moved to a position suitable for printing.

The sequence select means 45 judges whether the cartridge replacement is a first time replacement after the printer is procured, or whether it is for the resupply of ink, and selects the auction mode (S208).

If the cartridge replacement is a first time replacement after the printer is procured, i.e., the initial charging flag in the suction status storing means 46 is in an off state, the sequence select means 45 produces a signal for transmission to the suction control means 39 to operate the suction pump 52 which sucks from the print heads 17 and 18 the amount of ink-necessary for the initial charging, i.e., the amount of ink for discharging the maintenance liquid, which was charged into the print heads at the factory, and for completely removing the air bubbles from the print head 150 to make the print head ready for printing. If the cartridge replacement is for the resupply of ink, the suction status storing means 46 performs a normal suction operation (S209).

When those operations end, the home position is detected by the carriage position detecting means 34, and the carriage 11 is stopped at the home position (S210). The print head 150 is capped with the cap 51 of the capping unit, and the fact that the ink cartridge (7 or 8) has been replaced faultlessly is stored in the suction status storing means 46 (S211).

When the cartridge replacement is not carried out (S207), the type of ink cartridge to be replaced and the fact that suction from the ink cartridge is being deferred are stored into the suction status storing means 46 (S212).

Figure 18:
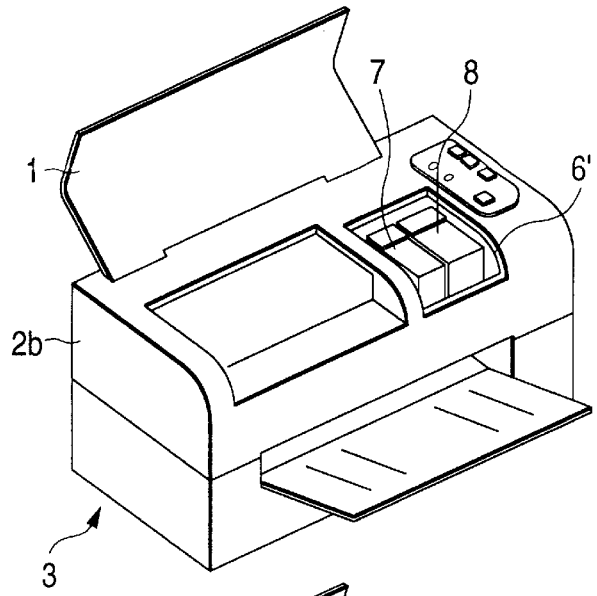
FIGS. 18(*a*) to 18(*c*) are diagrams showing other case structures to which the present invention is applicable.
Figure 18:
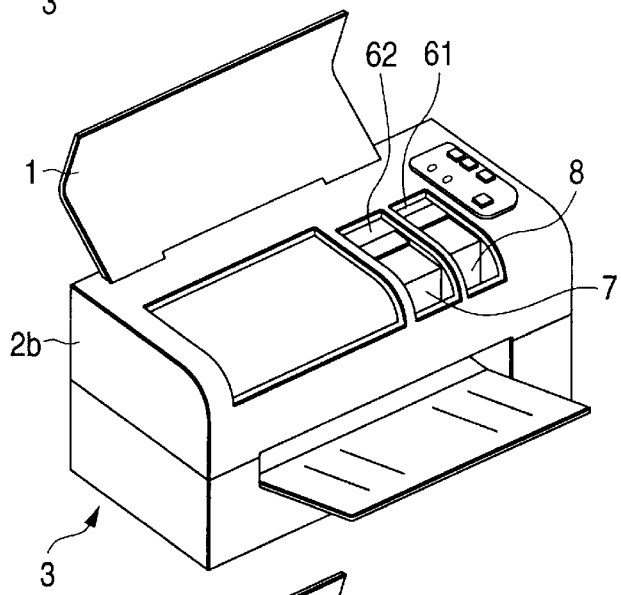
Figure 18:
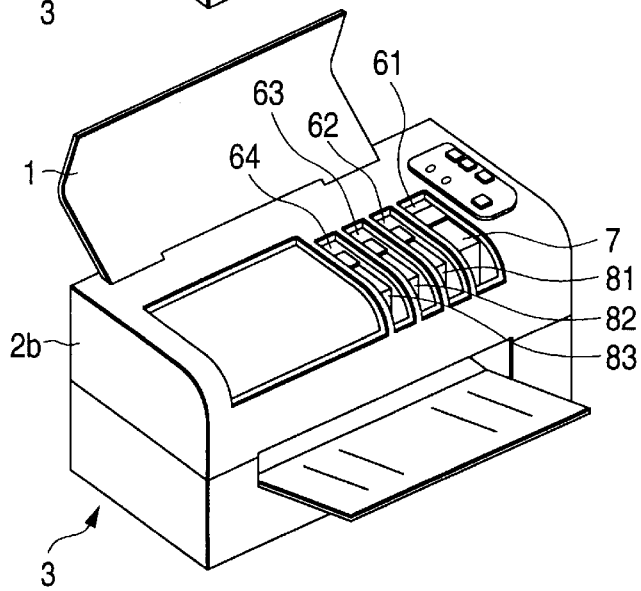

In the above-mentioned embodiment, the cartridge replacing position is defined by the window 6 and the partitioning portion 2*c* of the case body. In a printer having a window 6' through which the ink cartridges 7 and 8 are both exposed, as shown in FIG. 18(*a*), the cartridge replacing position may be specified by marking a proper position with a cartridge replacing position CP. In a printer shown in FIG. 18(*b*), windows 61 and 62 are respectively provided for specifying the cartridge replacing positions of the black ink cartridge and the color ink cartridge. A printer shown in FIG. 18(*c*) is provided with ink cartridges 81, 82 and 83 of different colors. In this printer, windows 62, 63 and 64 are provided at positions confronted with the color ink cartridges, respectively. In those printers, the kinds of ink cartridges can be clearly indicated by the utilization of a broad area of the case body. Therefore, there is no chance that the user erroneously selects the ink cartridge.

What is claimed is:

1. An ink jet recording device comprising:

a housing:

an ink jet print head for ejecting ink in the form of ink drops;

at least two ink cartridges for supplying ink to said print head;

a carriage on which said print head and said ink cartridges are mounted;

a cap for sealing said print head, said cap being located outside a printing section of said print head;

a suction device coupled to said cap for applying a negative pressure to said cap;

a window provided in said housing through which said ink cartridges are passable upon being replaced;

an external switch; and means, responsive to an operation of said external switch, for moving said carriage so that only one ink cartridge to be replaced is disposed in a position confronting said window to be completely exposed therethrough.

2. The ink jet recording device according to claim 1, wherein said window is dimensioned, such that only a single one of said ink cartridges is passable through said window at a time.

3. The ink jet recording device according to claim 1, wherein said window is dimensioned to expose a portion of an ink cartridge which is not being replaced.

4. The ink jet recording device according to claim 1, further comprising:

means for judging when more than one of said ink cartridges needs replacement; and means for controlling said means for moving to move a first one of said cartridges disposed in a non-printing section of said print head to the position confronting said window for replacement, and subsequently moving a second one of said cartridges disposed in said printing section of said print head to the position confronting said window for replacement.

5. The ink jet recording device according to claim 1, further comprising:

means for judging when more than one of said ink cartridges needs replacement; and means for controlling said means for moving to move a replaced ink cartridge to a cleaning position where said print head coupled with said replaced ink cartridge is wiped.

6. The ink jet recording device according to claim 1, further comprising:

means for detecting an amount of ink left in each ink cartridge; and means for detecting attachment or detachment of each ink cartridge to and from said print head, wherein said means for moving moves the ink cartridges to the position confronting said window in priority order including:

a first order priority when more than one ink cartridge needs replacement, a second order priority when one of the ink cartridges is not attached to the print head, a third order priority when the amount of ink in one ink cartridge is at an end level, a fourth order priority when the amount of ink in one ink cartridge is at a near end level, and a fifth order priority when the ink cartridges contain a sufficient amount of ink for printing.

7. The ink jet recording device according to claim 6, wherein, in response to a cartridge replacing instruction, only an ink cartridge having a residual ink amount less than the end level is moved to the position confronting said window.

8. The ink jet recording device according to claim 1, wherein said window confronts said cap.

9. The ink jet recording device according to claim 1, wherein, when more than one ink cartridge needs replacement, said means for moving moves said ink cartridges to the position confronting said window such that an ink cartridge located in a non-printing section is confronted with said window first.

10. An ink jet recording device comprising:

a housing;

an inkjet print head for ejecting ink in the form of ink drops;

at least two ink cartridges for supplying ink to said print head;

a carriage and on which said print head and said ink cartridges are mounted;

a cap for sealing said print head, said cap being located outside a printing section of said print head;

a suction device coupled to said cap for applying a negative pressure to said cap;

a window provided in said housing through which said ink cartridges are passable upon being replaced;

an external instruction switch;

means for detecting an amount of ink left in each ink cartridge and outputting a signal based on the detected amount; and means, responsive to an operation of said external instruction switch and said signal output from said means for detecting when the amount of ink left in said ink cartridges is less than a reference value, for moving said carriage so that the said ink cartridges are disposed at a position confronting said window.

11. The ink jet recording device according to claim 10, wherein said external instruction switch is for initiating a cleaning process for cleaning said print head; and wherein, after said external instruction switch is operated and before said cleaning process initiates, said means for detecting detects the amount of ink left in said ink cartridges, and if the amount of ink in one ink cartridge is less than said reference value, said means for moving moves said carriage so that said one ink cartridge is disposed at the position confronting said window.

12. The ink jet recording device according to claim 10, further comprising an ink level indicator, wherein, if the amount of ink in one or more of the cartridges is less than said reference value, said indicator indicates an ink end level, and said means for moving executes a cartridge replacing process for said one or more ink cartridges.

13. The ink jet recording device according to claim 10, wherein said reference value represents one of an ink near end and an ink end.

14. The ink jet recording device according to claim 10, wherein said reference value represents an amount of ink consumed in a cleaning process.

15. The ink jet recording device according to claim 10, wherein, before a cleaning process for cleaning said print head, said means for detecting detects the amount of ink left in an ink cartridge, and if the amount of ink is less than said reference value, said means for detecting detects an ink end level.

16. The ink jet recording device according to claim 10, wherein an ink cartridge having an ink level that is less than the reference value and an ink cartridge to be replaced are successively replaced.

17. An ink jet recording device comprising:

ink jet print heads for ejecting ink drops;

ink cartridges for supplying ink to said print heads;

a carriage on which said print heads and said ink cartridges are mounted;

at least one cap for sealing said print heads, said cap being located outside a printing section of said print head;

a suction device coupled to said cap for applying a negative pressure to said cap;

means for determining whether or not said ink cartridges are mounted on said carriage; and means for moving said carriage so that said print heads are disposed in a position where said ink cartridges can be replaced;

wherein, when said means for determining determines that one of said ink cartridges is not mounted on said carriage at a power on time, said means for moving moves said carriage so that the print head is disposed at said position where said one of said ink cartridges can be replaced.

18. The ink jet recording device according to claim 17, further comprising:

means for storing a status of a sucking operation of said suction device when ink is being sucked from one of said print heads at a time of cartridge replacement, and further storing in advance data indicating whether or not an initial ink charging to said print head has been performed;

wherein, (1) when the initial ink charging has never before been performed at the power on time, said means for moving moves said carriage to said position, and (2) when said means for determining determines that said ink cartridge is mounted on said carriage, said suction device performs the initial ink charging.

19. The ink jet recording device according to claim 18, wherein, when one of said ink cartridges is mounted on said carriage at the power on time and the initial ink charging is not yet performed, said suction device performs the initial ink charging.

20. The ink jet recording device according to claim 17, further comprising:

a case body having a window;

a case cover moveably mounted on said case body between (1) an open position in which said window is exposed and (2) a closed position in which said case cover covers said widow; and means for detecting when said case cover is in said open position;

wherein said position corresponds to said window, and when said means for determining determines that one of said ink cartridges is not mounted on said carriage, said means for moving moves said carriage so that a print head not yet coupled with an ink cartridge is disposed at said position.

21. The ink jet recording device according to claim 17, further comprising:

means for detecting an amount of ink left in said ink cartridges; and means for detecting a supply of electric power and a stop in the supply of electric power to the recording device;

wherein, when the amount of ink left in an ink cartridge is less than a reference value at a time when the supply of electric power is stopped, said means for moving moves said carriage so that a print head on which said ink cartridge is mounted is disposed at said position for replacement of said ink cartridge; and wherein, when the supply of electric power is stopped, said means for moving moves the carriage to another position where said print head is sealed by said cap.

22. An ink jet recording device comprising ink jet print heads for ejecting ink in the form of ink drops;

ink cartridges for supplying ink to said print heads;

a carriage on which said print heads and said ink cartridges are mounted;

at least one cap for sealing said print heads;

a pump coupled to said cap for applying a suction pressure to said cap;

an external switch that outputs a signal to start an ink cartridge replacing process;

means for storing data indicating whether or not said ink cartridges are being replaced, whether said ink cartridges are attached or detached, and whether a post-process for replacement of said ink cartridges is complete or incomplete; and means for controlling said carriage and said pump to execute said ink cartridge replacing process in response to said signal output from said external switch.

23. The ink jet recording device according to claim 22, further comprising means for detecting a supply of electric power and a stop in the supply of electric power to the recording device;

wherein, when said means for detecting detects the stop in the supply of electric power, said means for storing data stores a cartridge replacement status; and wherein, when data indicating whether or not said ink cartridges are being replaced is not stored in said means for storing at a time when electric power is restored, said means for controlling restarts the cartridge replacing process.

24. The ink jet recording device according to claim 23, wherein, when data indicating whether said ink cartridges are attached or detached is not stored in said means for storing at a time when the electric power in restored, said means for controlling starts the cartridge replacing process at a step in which said ink cartridge is attachable.

25. The ink jet recording device according to claim 23, wherein, when data indicating whether the post-process for replacement of said ink cartridges is occurring or not is not stored in said means for storing at a time when electric power is restored, said means for controlling starts the cartridge replacing process at a step in which the post-process is enabled.

26. The ink jet recording device according to claim 23, wherein, when data indicating whether the post-process for said ink cartridges is complete or not is not stored in said means for storing at a time when electric power is restored, said means for controlling starts the cartridge replacing process at a step in which the post-process is enabled.

27. The ink jet recording device according to claim 26, wherein setting of a cleaning instruction is executed when an amount of printing is less than a reference value after the cartridge replacement.

28. The ink jet recording device according to claim 22, wherein, in response to an instruction to replace said ink cartridges, said means for storing stores a location of said ink cartridges being replaced and defers execution of the post-process until said ink cartridges are replaced.

29. The ink jet recording device according to claim 22, wherein, when said external switch is operated to output said signal, said means for controlling checks the amount of ink left in said ink cartridge to be replaced, and if the amount of ink is at least ½ as much as an ink containing capacity of said ink cartridge, said means for controlling sets a suction amount at said cartridge replacement and a suction amount for a subsequent cleaning instruction to be large enough to remove any air bubbles from said print head.

30. The ink jet recording device according to claim 22, wherein said means for storing stores data indicating whether or not said suction device faultlessly executes a charging operation after the ink cartridge replacing process; and wherein, when data indicating a faultless charging operation is stored in said means for storing, said means for controlling sets a first auction amount for removing clogging of discharging orifices, said first suction amount being greater than a normal suction amount for clogging removal.

31. The ink jet recording device according to claim 30, wherein a flushing operation follows said charging operation.

32. The ink jet recording device according to claim 30, wherein said means for controlling initializes a positon of said carriage in synchronism with a suction step after cartridge replacement.

33. The ink jet recording device according to claim 22, wherein, when one of said ink cartridges needs replacement, said means for controlling controls a suchtion pressure of said pump for ink charging to be a suction amount of said ink cartridge to be replaced; and wherein, when more than one of said ink cartridges needs replacement, said means for controlling controls the suction pressure of said pump for ink charging to be a largest suction amount of said more than one ink cartridge to be replaced.

34. The ink jet recording device according to claim 22, further including a plurality of said pumps;

wherein said ink jet print heads are sucked by different ones of said pumps, and said means for controlling controls a print head that is coupled with a newly replaced ink cartridge to be sucked for ink charging thereinto, and controls a print head that is coupled with an ink cartridge that was not replaced to be flushed.

35. The ink jet recording device according to claim 22, wherein, when said ink cartridges are not one of (1) replaced within a preset time after said signal is output by said external switch, and (2) replaced after a preset time elapses in a state, where all of said ink cartridges are attached or detached, said means for controlling forcibly stops the cartridge replacing process.

36. The ink jet recording device according to claim 35, wherein said preset time is 30 to 300 seconds.

37. The ink jet recording device according to claim 35, further comprising an alarm that is generated when said carriage is moved to a home position.

38. The ink jet recording device according to claim 22, wherein, after the cartridge replacement process, said means for controlling moves said carriage by at least one of a lower drive force and a lower speed as compared with a normal drive force and a normal speed during printing, or back and forth at a speed that produces a motion of the carriage that is recognized by the user, and thereafter moves said carriage by said normal drive force or said normal speed to a home position.

* * * * *